US010050395B2

(12) United States Patent
Ngo et al.

(10) Patent No.: US 10,050,395 B2
(45) Date of Patent: Aug. 14, 2018

(54) CABLE FOR ELECTRICAL POWER CONNECTION

(71) Applicant: FCI USA LLC, Etters, PA (US)

(72) Inventors: Hung Viet Ngo, Etters, PA (US); Charles M. Gross, Etters, PA (US); Christopher J. Kolivoski, Lewisberry, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/039,654

(22) PCT Filed: Dec. 5, 2014

(86) PCT No.: PCT/US2014/068779
§ 371 (c)(1),
(2) Date: May 26, 2016

(87) PCT Pub. No.: WO2015/085166
PCT Pub. Date: Jun. 11, 2015

(65) Prior Publication Data

US 2017/0170615 A1 Jun. 15, 2017

Related U.S. Application Data

(60) Provisional application No. 61/912,892, filed on Dec. 6, 2013, provisional application No. 61/931,962, filed
(Continued)

(51) Int. Cl.
*H01R 13/514* (2006.01)
*H01R 43/16* (2006.01)
(Continued)

(52) U.S. Cl.
CPC ..... *H01R 25/162* (2013.01); *H01R 4/023* (2013.01); *H01R 13/6275* (2013.01); *H01R 13/74* (2013.01)

(58) Field of Classification Search
CPC ..... H01R 13/514; H01R 12/75; H01R 11/12; H01R 12/721; H01R 13/113;
(Continued)

(56) References Cited

U.S. PATENT DOCUMENTS 3,845,455 A 10/1974 Shoemaker
3,936,128 A 2/1976 D'Annessa et al.
(Continued)

FOREIGN PATENT DOCUMENTS

CN 1348621 A 5/2002
CN 1589511 A 3/2005
(Continued)

OTHER PUBLICATIONS

International Search Report and Written Opinion for International Application No. PCT/US2014/068779 dated Feb. 27, 2015.
(Continued)

*Primary Examiner* — Michael A Lyons
*Assistant Examiner* — Matthew T Dzierzynski
(74) *Attorney, Agent, or Firm* — Wolf, Greenfield & Sacks, P.C.

(57) ABSTRACT

Electrical cables are described having strands of fibers of wire that are fused together at their ends to facilitate attachment to a respective mating member and mounting member.

20 Claims, 28 Drawing Sheets

Related U.S. Application Data on Jan. 27, 2014, provisional application No. 61/969,719, filed on Mar. 24, 2014.

(51) Int. Cl.

| | |
|---|---|
| ***H01R 25/16*** | (2006.01) |
| ***H01R 4/02*** | (2006.01) |
| ***H01R 13/74*** | (2006.01) |
| ***H01R 13/627*** | (2006.01) |

(58) Field of Classification Search

CPC .. H01R 13/516; H01R 13/6273; H01R 43/16; H01R 43/18; H01R 12/7005; H01R 12/7023; H01R 12/716; H01R 12/737; H01R 13/025; H01R 13/04; H01R 13/052; H01R 13/111; H01R 13/33; H01R 13/422; H01R 13/424; H01R 13/434; H01R 13/5205; H01R 13/5812; H01R 13/6275; H01R 13/64; H01R 2101/00; H01R 2103/00; H01R 24/00; H01R 24/20; H01R 24/542; H01R 4/5025

See application file for complete search history.

(56) References Cited

U.S. PATENT DOCUMENTS

| | | | | |
|---|---|---|---|---|
| 4,026,013 | A | 5/1977 | Hughes | |
| 4,039,239 | A | 8/1977 | Cobaugh et al. | |
| 4,192,570 | A | 3/1980 | Van Horn | |
| 4,220,390 | A | 9/1980 | Cobaugh et al. | |
| 4,261,629 | A | 4/1981 | Reynolds et al. | |
| 4,277,124 | A | 7/1981 | Loose et al. | |
| 4,363,529 | A | 12/1982 | Loose | |
| 4,533,199 | A | 8/1985 | Feldberg | |
| 4,544,220 | A * | 10/1985 | Aiello | H01R 13/424 439/594 |
| 4,575,173 | A | 3/1986 | Chapin et al. | |
| 4,648,676 | A | 3/1987 | Carrell | |
| 4,701,001 | A | 10/1987 | Verhoeven | |
| 4,716,651 | A | 1/1988 | Klaiber et al. | |
| 4,995,825 | A | 2/1991 | Korsunsky et al. | |
| 5,022,868 | A | 6/1991 | Legrady | |
| 5,122,081 | A * | 6/1992 | Bogiel | H01R 13/422 439/595 |
| 5,393,951 | A * | 2/1995 | Kasper | B23K 11/36 174/133 B |
| 5,551,889 | A | 9/1996 | Kozel et al. | |
| 5,562,478 | A | 10/1996 | Yamamoto | |
| 5,586,905 | A | 12/1996 | Marshall et al. | |
| 5,669,778 | A | 9/1997 | Kramer et al. | |
| 5,807,121 | A | 9/1998 | Fulop et al. | |
| 5,820,402 | A | 10/1998 | Chiacchio et al. | |
| 5,820,404 | A | 10/1998 | Chishima et al. | |
| 5,960,540 | A | 10/1999 | Pentz | |
| 6,074,238 | A | 6/2000 | DeRoss et al. | |
| 6,325,659 | B1 | 12/2001 | Heinzen et al. | |
| 6,394,833 | B1 | 5/2002 | Bulmer et al. | |
| 6,443,752 | B1 | 9/2002 | Kosawa | |
| 6,554,633 | B1 | 4/2003 | Nobuyuki et al. | |
| 6,573,450 | B2 * | 6/2003 | Saito | H01R 13/5205 16/2.1 |
| 6,979,222 | B2 | 12/2005 | Comini | |
| D516,521 | S | 3/2006 | Yao et al. | |
| 7,011,543 | B2 | 3/2006 | Hiramoto et al. | |
| 7,033,233 | B2 * | 4/2006 | Fujimoto | B23H 11/006 439/874 |
| 7,059,889 | B1 | 6/2006 | Pavlovic et al. | |
| 7,059,892 | B1 * | 6/2006 | Trout | H01R 13/5812 439/460 |
| 7,134,903 | B1 | 11/2006 | Pavlovic | |
| 7,137,848 | B1 * | 11/2006 | Trout | H01R 13/514 439/170 |
| 7,160,156 | B2 * | 1/2007 | Holliday | H01R 4/5025 439/585 |
| D555,092 | S | 11/2007 | Li et al. | |
| D569,801 | S | 5/2008 | Chuang | |
| D569,802 | S | 5/2008 | Long et al. | |
| D645,827 | S | 9/2011 | Lee et al. | |
| 8,109,783 | B2 | 2/2012 | Bishop et al. | |
| 8,323,049 | B2 * | 12/2012 | Ngo | H01R 13/6275 439/552 |
| 8,403,707 | B2 * | 3/2013 | Tai | H01R 13/434 439/397 |
| D688,246 | S | 8/2013 | Lee | |
| 8,740,638 | B2 | 6/2014 | Lappoehn | |
| 8,794,991 | B2 * | 8/2014 | Ngo | H01R 12/75 439/350 |
| 9,136,652 | B2 * | 9/2015 | Ngo | H01R 24/00 |
| 9,289,848 | B2 * | 3/2016 | Handel | B23K 20/2336 |
| 9,543,664 | B2 | 1/2017 | Sabo | |
| 9,543,665 | B2 | 1/2017 | Sabo | |
| 2002/0192997 | A1 | 12/2002 | Turek et al. | |
| 2003/0171023 | A1 | 9/2003 | Turek et al. | |
| 2004/0185703 | A1 | 9/2004 | Lee | |
| 2005/0191883 | A1 | 9/2005 | Woodward | |
| 2007/0082539 | A1 | 4/2007 | Pavlovic | |
| 2007/0254521 | A1 | 11/2007 | D'Agostini et al. | |
| 2008/0286991 | A1 | 11/2008 | Northey | |
| 2010/0068916 | A1 | 3/2010 | Chen | |
| 2010/0203752 | A1 | 8/2010 | Urano | |
| 2010/0210151 | A1 | 8/2010 | Niles et al. | |
| 2011/0059632 | A1 | 3/2011 | Bishop | |
| 2011/0217866 | A1 | 9/2011 | Roosdorp et al. | |
| 2012/0003850 | A1 | 1/2012 | Bishop et al. | |
| 2012/0052733 | A1 | 3/2012 | Zhu | |
| 2012/0149233 | A1 | 6/2012 | Hsueh | |
| 2012/0171909 | A1 | 7/2012 | Harada | |
| 2012/0238127 | A1 | 9/2012 | Bishop | |
| 2013/0040483 | A1 | 2/2013 | Ngo et al. | |
| 2013/0040500 | A1 | 2/2013 | Ngo et al. | |
| 2013/0225013 | A1 | 8/2013 | Peng | |
| 2015/0038002 | A1 | 2/2015 | Sabo | |
| 2015/0038003 | A1 | 2/2015 | Sabo | |
| 2016/0072200 | A1 | 3/2016 | Sabo | |

FOREIGN PATENT DOCUMENTS

| | | | |
|---|---|---|---|
| CN | 101527399 | A | 9/2009 |
| CN | 101641840 | A | 2/2010 |
| DE | 25 33 694 | A1 | 2/1977 |
| FR | 2852744 | A1 | 9/2004 |
| JP | 2001-266972 | A | 9/2001 |
| KR | 10-1987-0000780 | | 2/1987 |
| KR | 10-1987-0007613 | | 6/1995 |
| TW | 576572 | U | 2/2004 |
| WO | WO 2012/123811 | A2 | 9/2012 |
| WO | WO 2014/172414 | A1 | 10/2014 |

OTHER PUBLICATIONS

International Preliminary Report on Patentability for International Application No. PCT/US2014/068779 dated Jun. 16, 2016.

Extended European Search Report for European Application No. 14784685.1 dated Nov. 10, 2016.

International Search Report and Written Opinion for International Application No. PCT/US2014/034289 dated Aug. 29, 2014.

International Preliminary Report on Patentability for International Application No. PCT/US2014/034289 dated Oct. 29, 2015.

Extended European Search Report for European Application No. 14831774.6 dated Jan. 31, 2017.

International Search Report and Written Opinion for International Application No. PCT/US2014/048781 dated Nov. 12, 2014.

International Search Report and Written Opinion for International Application No. PCT/US2016/019283 dated Jun. 9, 2016.

* cited by examiner

CABLE FOR ELECTRICAL POWER CONNECTION

CROSS-REFERENCE TO RELATED APPLICATIONS

This application is the National Stage of International Application No. PCT/US2014/068779, filed Dec. 5, 2014, which claims the benefit of U.S. application No. 61/912,892, filed Dec. 6, 2013; U.S. application No. 61/931,962, filed Jan. 27, 2014; and U.S. application No. 61/969,719, filed Mar. 24, 2014 the disclosures of which are incorporated herein by reference in their entireties.

BACKGROUND

Electrical cable assemblies typically include at least one electrical conductor, and an electrical insulator that surrounds the electrical conductor. The at least one electrical conductor typically defines a first end for electrical connection to a mating member, and a second end for electrical connection to a mounting member. The mating and mounting members can be placed in electrical communication with respective complementary electrical devices. The at least one electrical conductor can be configured to carry electrical power or data signals between the complementary electrical devices.

SUMMARY

In accordance with one embodiment, an electrical cable assembly can include a plurality of stranded electrically conductive fibers of wire extending from a first end to a second end. The electrical cable assembly can also include an electrical insulator surrounding the plurality of strands of wire, such that each of the first and second ends extends out from the electrical insulator. The fibers of wire of at least one of the first and second ends can be shaped so as to define at least one keyed surface, and fused to each other while shaped so as to define a solidified shape having the at least one keyed surface, prior to electrically connecting the at least one of the first and second ends to a mating member or mounting member, respectively.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1:
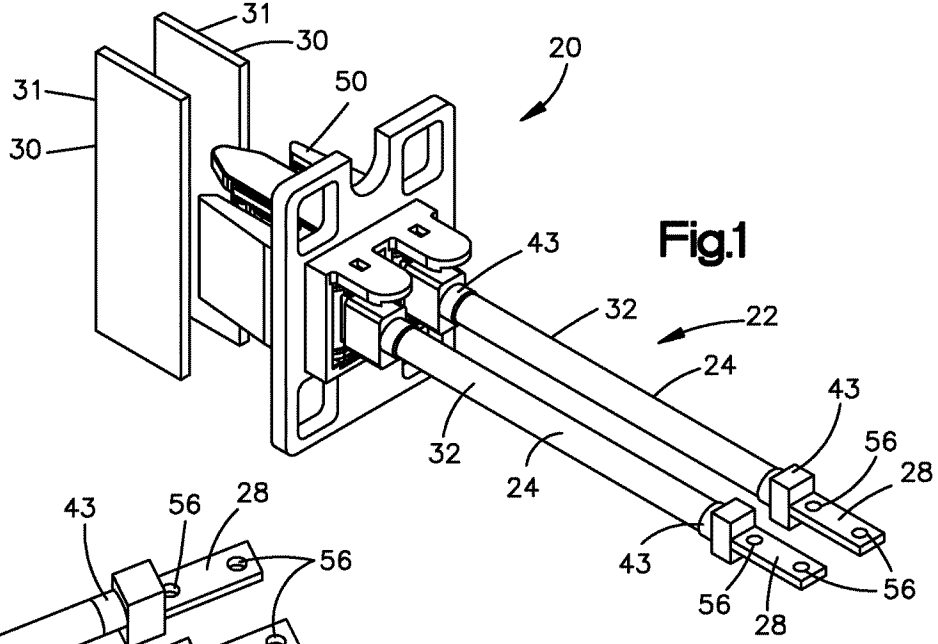
FIG. 1 is a perspective view of an electrical assembly constructed in accordance with one embodiment, including an electrical cable assembly.

Referring to FIGS. 1A-4J generally, an electrical assembly 20 can include an electrical cable assembly 22 that includes an electrical cable 24 that defines a first end 24*a* and a second end 24*b* opposite the first end 24*a*. The cable assembly 22 can further include an electrically conductive mating member 26 and an electrically conductive mounting member 28 that are each configured to be attached to the electrical cable 24 so as to place the electrical cable 24 in electrical communication with each of the mating member 26 and the mounting member 28. For instance, the first end 24*a* is configured to connect to the mating member 26, and the second end 24*b* is configured to connect to the mounting member 28. The electrical assembly 20 can further include a first complementary electrical device 30 and a second complementary electrical device. The mating member 26 is configured to mate with the first complementary electrical device 30 so as to place the first complementary electrical device in electrical communication with the mating member 26. The mounting member 28 is configured to be mounted to the second complementary electrical device so as to place the second complementary electrical device in electrical communication with the mounting member 28. The electrical cable assembly 22, including the electrical cable 24, can be configured to carry electrical power or data signals as desired. For instance, in accordance with one embodiment, the first electrical device 30 can carry electrical power, such that the electrical assembly 20 is configured as an electrical power assembly. For example, the first electrical device 30 can be configured as an electrical power rail 31. In accordance with an alternative embodiment, the first electrical device can be configured to carry data signals. The second electrical device can be configured as a substrate, such as an electrical power bus or a printed circuit board having electrically conductive contact pads and electrically conductive traces that are in electrical communication with the electrically conductive contact pads. It should be appreciated that each of the first and second complementary electrical devices can be configured as any suitable constructed alternative electrical device desired.

The electrical cable 24, and thus the electrical cable assembly 22, can include a plurality of stranded electrically conductive fibers of wire extending from the first end 24*a* to the second end 24*b*. For instance, the stranded electrically conductive fibers of wire can be braided with each other between the first end and the second end. The electrical cable 24, and thus, the electrical cable assembly 22, can further include an electrical insulator 32 that surrounds the plurality of strands of wire 33, such that each of the first and second ends 24*a* and 24*b* extends out from the electrical insulator 32. The fibers of wire of at least one of the first and second ends 24*a* and 24*b* are shaped so as to define at least one keyed surface 34, and fused to each other while shaped so as to define a solidified shape 36 having the at least one keyed surface 34, prior to electrically connecting the at least one of the first and second ends 24*a* and 24*b* to the respective mating member 26 or mounting member 28. For instance, the fibers of wire can be ultrasonically bonded, welded, or soldered to each other at one or both of the first and second ends 24*a* and 24*b* so as to fuse the fibers of wire to each other. For instance the first end 24*a* can be shaped so as to define the at least one keyed surface 34 prior to electrically connecting the first end 24*a* to the mating member 26. Alternatively or additionally, the second end 24*b* can be shaped so as to define the at least one keyed surface 34 prior to electrically connecting the second end 24*b* to the mounting member 28.

The electrical cable assembly 22, and in particular the mating member 26, can include at least one electrically conductive contact member 37 that defines at least one contact surface 38. For instance, the electrical cable assembly 22 can include a first at least one contact surface 38 in electrical communication with the mating member 26, and a second at least one contact surface 38 in electrical communication with the mounting member 28. The keyed surfaces 34 are configured to be placed in contact with the respective ones of the contact surfaces 38, thereby establishing an electrical connection between at least one or both of the first and second ends 24*a* and 24*b*, and the mating member 26 or mounting member 28, respectively. For instance, the keyed surfaces 34 are configured to be placed in contact with the respective ones of the contact surfaces 38, thereby establishing an electrical connection between the first end 24*a* and the mating member 26, and an electrical connection between the second end 24*b* and the mounting member 28. For instance, each of the keyed surfaces 34 can be sized and shaped to be placed in surface contact with the respective contact surfaces 38 prior to placing the keyed surfaces 34 in contact with the respective contact surfaces 38. Thus, when the keyed surfaces 34 are placed in contact with the respective contact surfaces 38, the keyed surfaces 34 and the contact surfaces 38 are in surface contact with each other. Because the keyed surfaces 34 permit surface contact only when the respective first and second ends 24*a* and 24*b* are in one or more predetermined orientations with relative to the respective contact surfaces 38 in order to be placed in surface contact, the surfaces can be referred to as keyed. The keyed surfaces 34 can be flat surfaces, or alternatively shaped surfaces as desired. Similarly, the contact surfaces 38 can be flat surfaces or alternatively shaped surfaces as desired, so as to correspond with the shape of the keyed surfaces 34.

The keyed surfaces 34 are configured to be fused to the respective contact surface 38 after the keyed surfaces 34 have been placed in contact with the respective contact surfaces 38. For instance, the keyed surfaces 34 can be ultrasonically bonded, welded, or soldered to the respective contact surface 38 so as to fuse the keyed surface 34 to the contact surfaces 38. Accordingly, the electrical cable 24 can be attached to the mating member 26 and the mounting member 28 without the use of crimp sleeves. Further, the mating member 26 can be sized as desired to attach to any desired first electrical component so long as the respective contact surface 38 is configured to fuse to the first end 24*a*. Furthermore, the fused keyed surfaces 34 and contact surfaces 38 produce higher tensile pull out forces than crimped sleeves, and exhibit a better temperature rise than crimp sleeves. Additionally, the electrical cable 24 can have different sizes but still configured to attach to the same mating member 26 and mounting member 28.

The electrical cable assembly 22 can further include an electrically insulative material 43, such as a first shrink wrap that can be configured as a shrink tube, that can surround and thus overlap at least a portion of the electrical insulator 32, and can surround the first end 24*a*. The first shrink wrap can further surround the respective contact surface 38 that is in electrical communication with the mating member 26. The electrical cable assembly 22 can further include an electrically insulative material 43, such as a second shrink wrap that can be configured as a shrink tube, that can surround and thus overlap at least a portion of the electrical insulator 32, and can surround the second end 24*b*, and further surrounds the respective contact surface 38, for instance that is in electrical communication with the mounting member 28. The shrink tubes can be placed over the electrical cable 24, such that they are aligned with the first and second ends 24*a* and 24*b*, the respective contact surfaces 38, and overlap at least a portion of the electrical insulator, and heat can be applied to the shrink tubes to cause them to shrink and seal over the first and second ends, the contact surfaces 38, and the overlapped portion of the electrical insulator.

In accordance with one embodiment, one or both of the contact surfaces 38, for instance the contact surface 38 in electrical communication with the mating member 26, can define a receptacle 40 that is configured to receive the respective one of the first and second ends 24*a* and 24*b*, for instance the first end 24*a*, so as place the respective keyed surface 34 in contact with the respective contact surface 38. Thus, the at least one keyed surface 34 of the first end 24*a* is configured to be received by the receptacle 40 and subsequently fused to the at least one contact surface 38. It should be appreciated that the mating member 26 is in electrical communication with the respective at least one contact surface 38 prior to connection of the corresponding at least one keyed surface 34 with the contact surface 38.

The mating member 26 can define an electrical receptacle 42 that is configured to receive a complementary electrical contact, for instance of the first complementary electrical device 30 so as to place the mating member 26, and thus the electrical cable 24, in electrical communication with the first complementary electrical device 30. Thus, the electrical receptacle 42 can be sized to receive the power rail 31, thereby placing the mating member 26 in electrical communication with the power rail 31, and also placing the electrical cable 24 in electrical communication with the power rail 31. For instance, the mating member 26 can include first and second electrical conductors that, in turn, define first and second arms 44 that cooperate with each other so as to define the receptacle 42 of the mating member 26. The mating member 26 can be substantially U-shaped, such that the first and second arms 44 are monolithic with each other. Alternatively, the first and second arms 44 can be separate from each other, and attached to each other as desired. The respective at least one contact surface 38 can be placed in contact, or otherwise placed in electrical communication, with one or both of the first and second arms 44. For instance, the respective at least one contact member 37 can be monolithic with the first and second arms 44. The mating member 26 can further include an electrically conductive shroud 46 having first and second shroud arms 48*a* and 48*b* that are disposed adjacent and outboard of the first and second arms 44, respectively, such that each of the first and second arms 44 is disposed between the first and second shroud arms 48*a-b*. Thus, when the first and second arms 44 deflect away from each other as they receive the complementary electrical contact in the receptacle 42, the first and second arms 44*a-b* can abut the first and second shroud arms 48*a-b*, respectively, so as to provide structural support to the first and second arms 44 and increase the normal force against the received electrical contact. Thus shroud 46 can be substantially U-shaped, such that the shroud arms 48*a-b* are monolithic with each other. The shroud arms 48*a-b* can be resiliently deflectable away from each other. The shroud 46 can further be electrically conductive. The at least one contact member 37 can extend through the shroud 46 in a rearward direction, which can be along the longitudinal direction L.

The electrical cable assembly 22 can include an electrically insulative housing 50 that surrounds the mating member 26 and can include a mounting member, such as a mounting plate 51, that is configured to be mounted onto a panel or other suitable support member. For instance, the housing 50, for example the mounting plate 51, can define at least one securement member configured to attach to the panel or other suitable support member. The securement member can be configured as one or more apertures 52 configured to receive hardware 75 that attaches the housing 50 to the panel or support member. Alternatively or additionally, the housing 50 can include a securement member configured as one or more latches 55 (see FIGS. 3A-4J). The latch 55 can include a projection 59 that is configured to be inserted into an aperture 69 of the power rail 31. The housing 50 can define a receptacle configured to receive the complementary electrical device, which can be configured as an electrical contact, such as the power rail, which is then received between the arms 44 of the mating member 26. The mating member 26 can include a latch arm 60 that is configured to interfere with the housing 50 when the mating member 26 is inserted into the housing 50. For instance, the mating member 26 can be inserted into a channel 62 of the housing 50 in a forward direction, and interference between the latch arm 60 and a retention surface 73, of the housing 50 can prevent backout of the mating member 26 from the housing 50 in a rearward direction that is opposite the forward direction. The housing 50 can further include at least one housing receptacle 77 that is aligned with the at least one receptacle 42 defined by the mating members 26. Accordingly, the power rail 31 can be inserted into the housing receptacle 77 and then into the receptacle 42 so as to contact the mating member 26.

As described above, the at least one keyed surface 34 of the second end 24*b* is configured to be placed against the respective contact surface 38 that is in electrical communication with the mounting member 28, and subsequently fused to the respective contact surface 38. For instance, the keyed surfaces 34 can be ultrasonically bonded, welded, or soldered to the respective contact surface 38 so as to fuse the keyed surface 34 to the contact surfaces 38 in the manner described above. It should be appreciated that the mounting member 28 is in electrical communication with the respective at least one contact surface 38 prior to connection of the at least one keyed surface 34 of the second end 24*b* with the contact surface 38. The second end 24*b* and the respective contact surface 38 can each be planar or alternatively shaped as desired. In accordance with the illustrated embodiment, the mounting member 28 can be configured as a plate, such as a fusion lug, having a surface that defines the respective contact surface 38. Thus, the mounting member 28 can be monolithic with the respective at least one contact surface 38. The mounting member 28 can define a securement member 56 that is configured to secure the mounting member 28 to the underlying substrate. For instance, the securement member 56 can be configured as one or more through holes configured to receive hardware that secures the mounting member 28 to the underlying substrate. The mounting member 28 can be placed against at least one contact pad of the underlying substrate when mounted to the substrate so as to place the mounting member 28, and thus the electrical cable 24, in electrical communication with the electrical traces of the substrate.

Figure 2A:
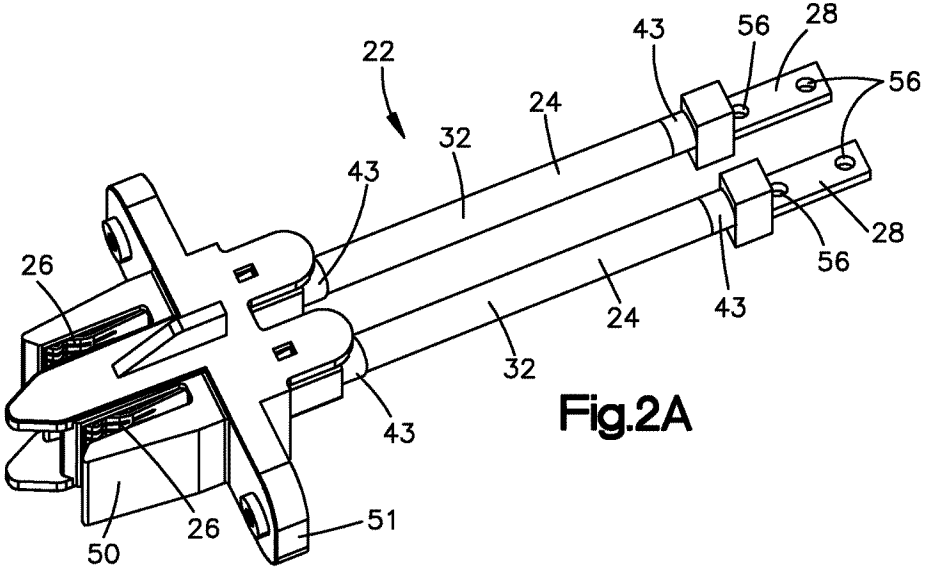
FIG. 2A is a perspective view of the electrical cable assembly illustrated in FIG. 1.
Figure 2C:
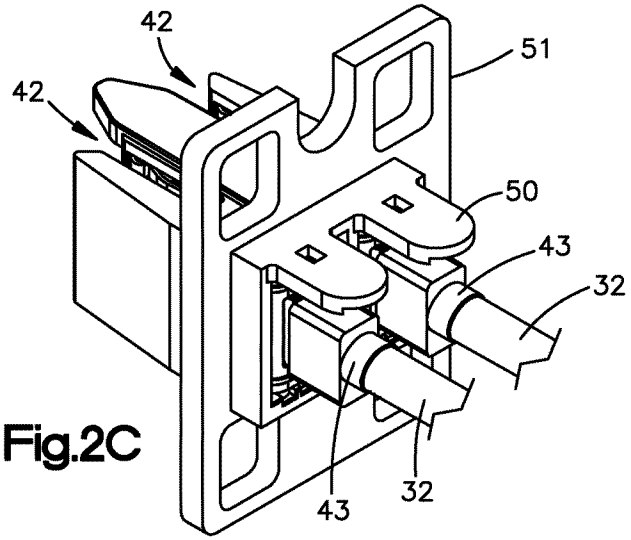
FIG. 2C is a perspective view of a portion of the electrical cable assembly illustrated in FIG. 2A.
Figure 2D:
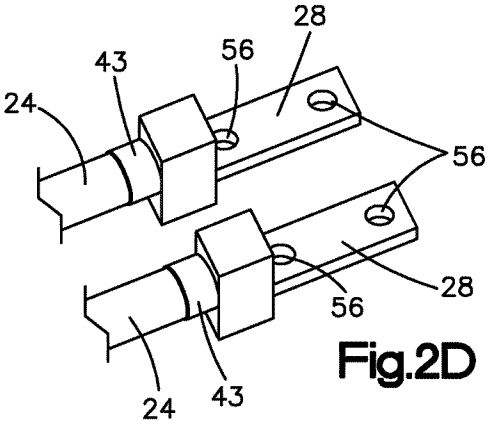
FIG. 2D is a perspective view of a portion of the electrical cable assembly illustrated in FIG. 2A.
Figure 2B:
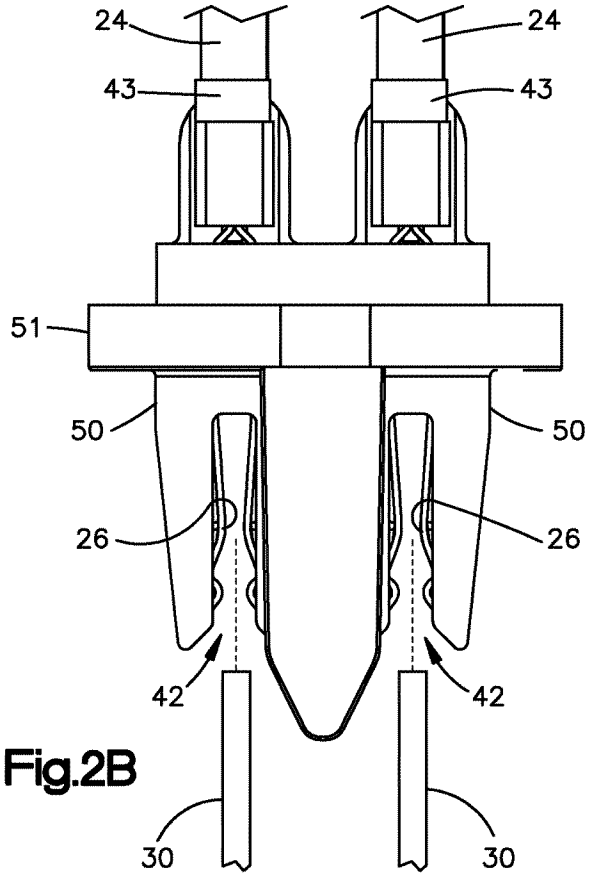
FIG. 2B is a top plan view of a portion of the electrical cable assembly illustrated in FIG. 2A.
Figure 2E:
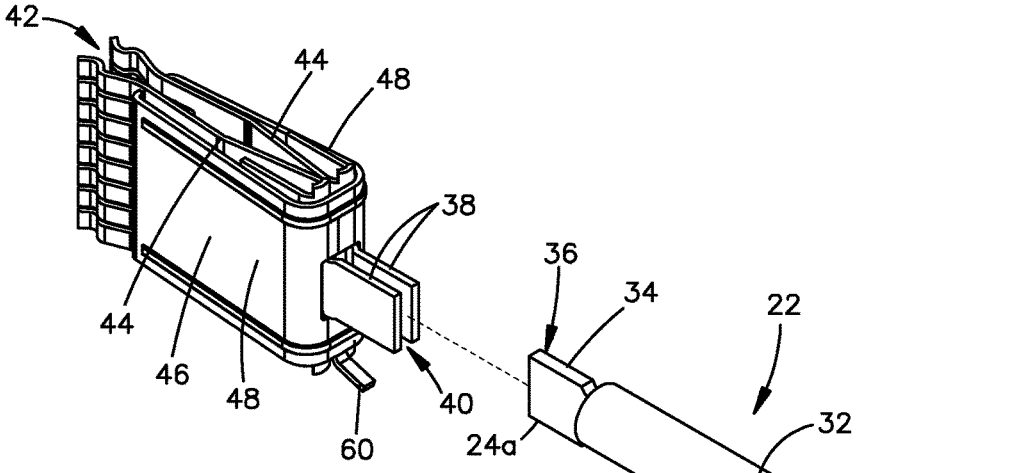
FIG. 2E is a perspective view of a portion of the electrical cable assembly illustrated in FIG. 2A, showing a step of assembling the electrical cable assembly.
Figure 2F:
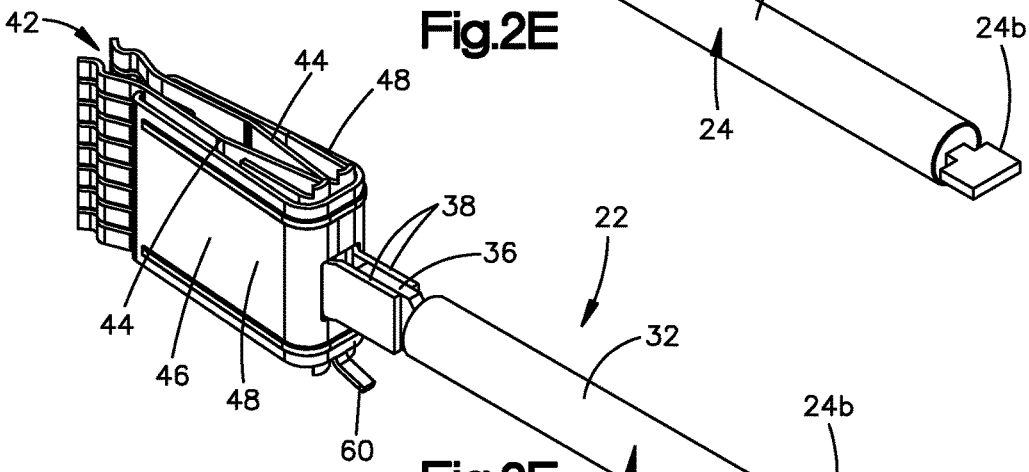
FIG. 2F is a perspective view of a portion of the electrical cable assembly illustrated in FIG. 2A, showing another step of assembling the electrical cable assembly.
Figure 2G:
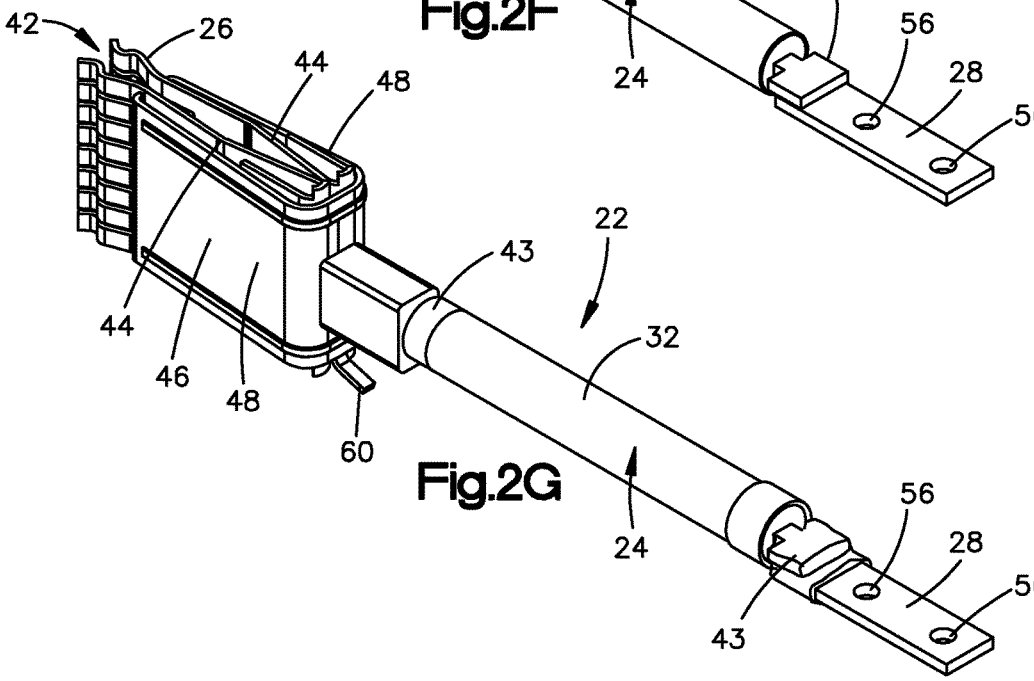
FIG. 2G is a perspective view of a portion of the electrical cable assembly illustrated in FIG. 2A, showing yet another step of assembling the electrical cable assembly.
Figure 2H:
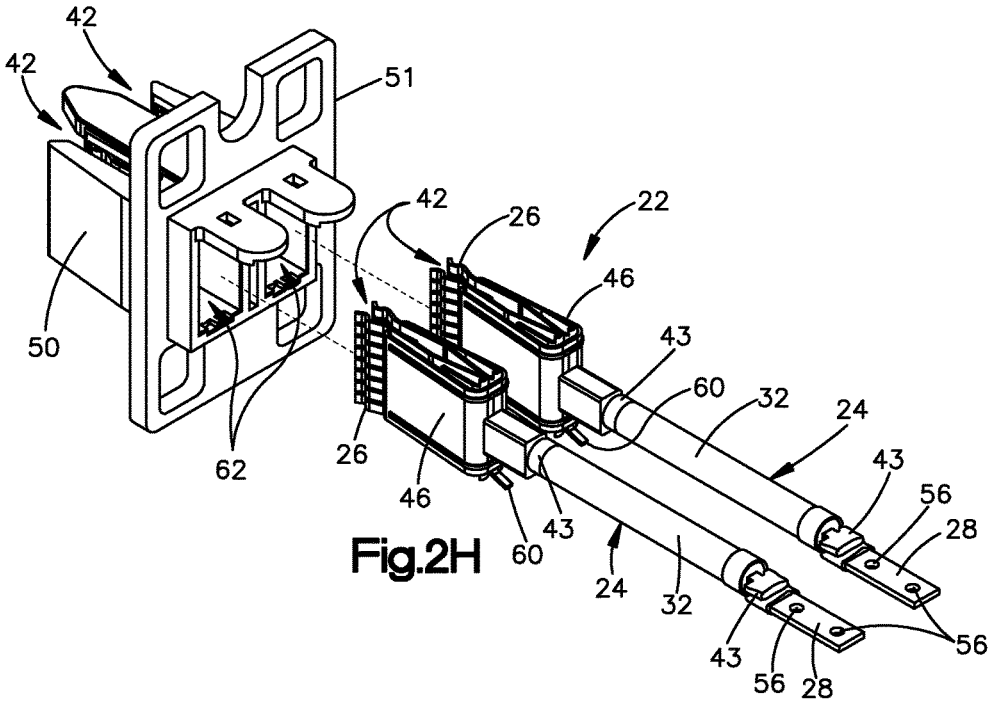
FIG. 2H is a perspective view of a portion of the electrical cable assembly illustrated in FIG. 2A, showing still another step of assembling the electrical cable assembly.
Figure 2I:
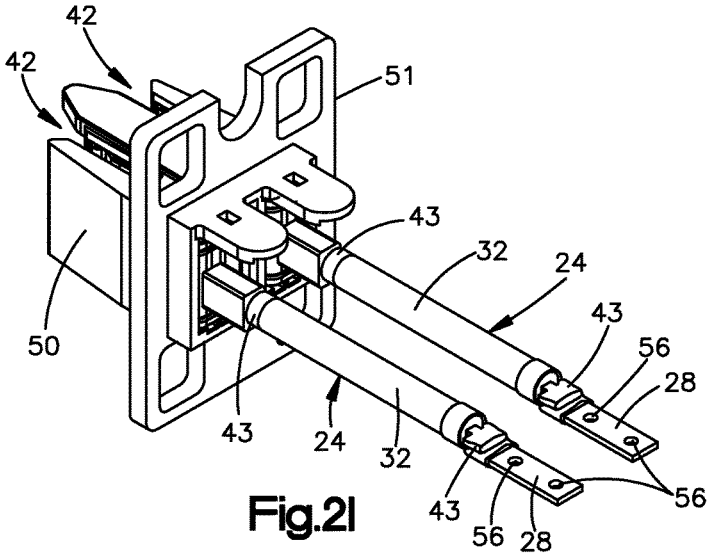
FIG. 2I is another perspective view of the electrical cable assembly illustrated in FIG. 2A, after the step of assembling illustrated in FIG. 2H.
Figure 2J:
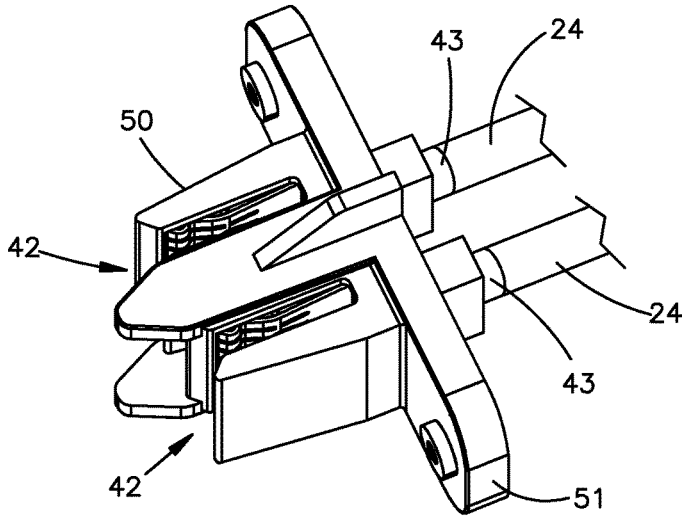
FIG. 2J is another perspective view of a portion of the electrical cable assembly illustrated in FIG. 2A.
Figure 2K:
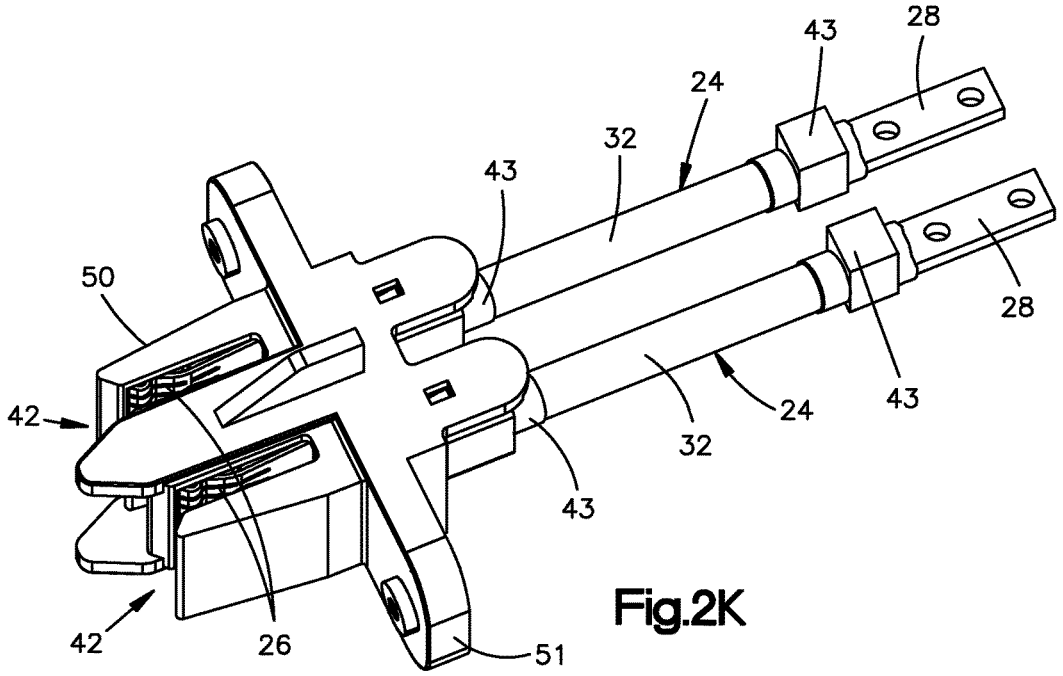
FIG. 2K is another perspective view of a portion of the electrical cable assembly illustrated in FIG. 2A.
Figure 2L:
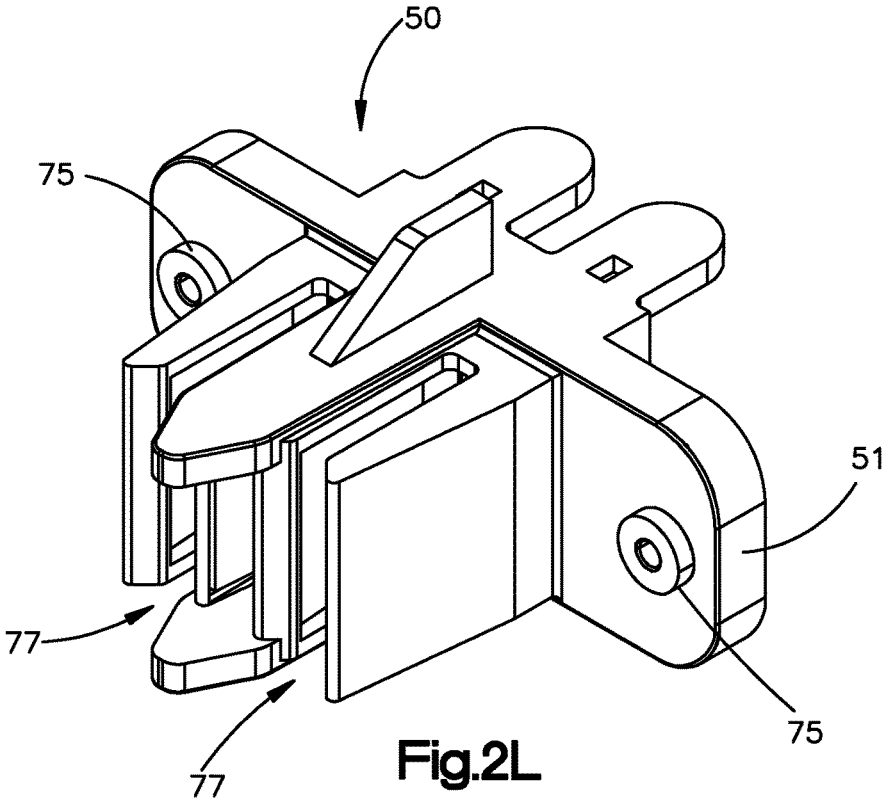
FIG. 2L is a perspective view of a housing of the electrical cable assembly illustrated in FIG. 2A.
Figure 2M:
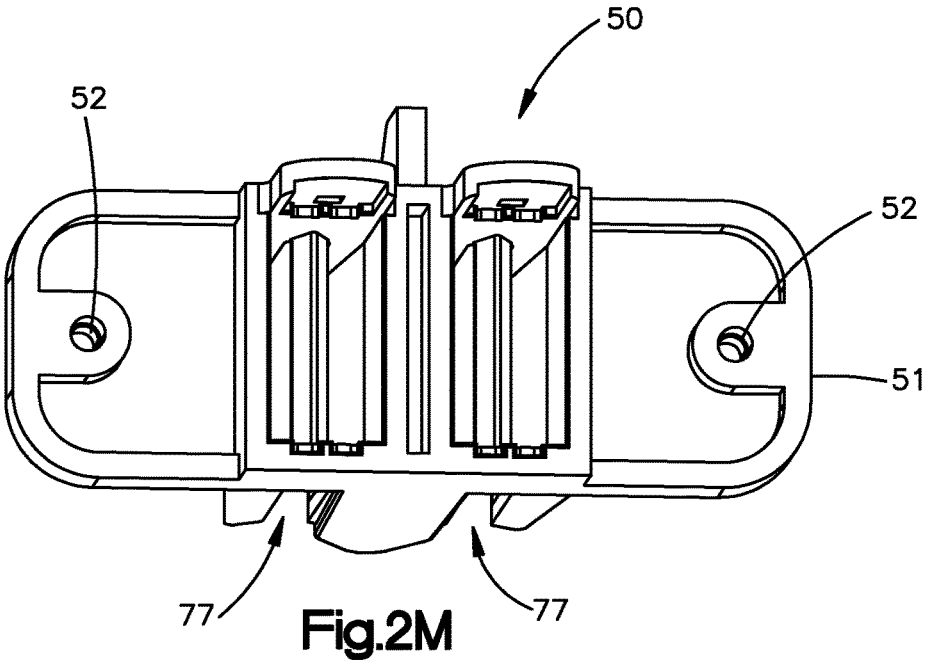
FIG. 2M is another perspective view of a housing of the electrical cable assembly illustrated in FIG. 2A.
Figure 3A:
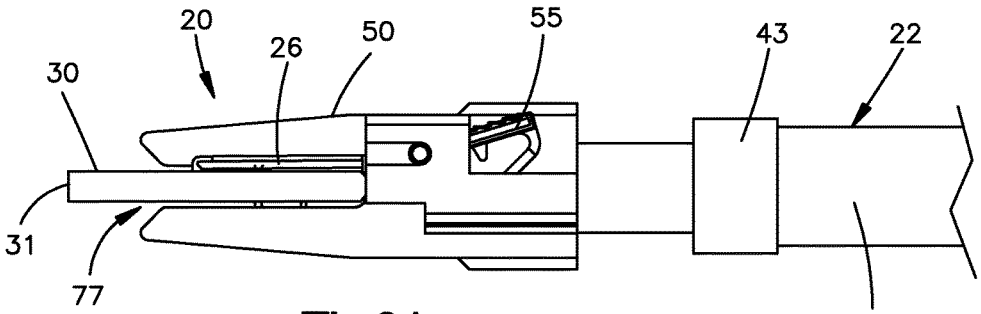
FIG. 3A is a top plan view of a portion of an electrical assembly similar to the electrical assembly illustrated in FIG. 1, but showing the connector housing constructed in accordance with an alternative embodiment.
Figure 3B:
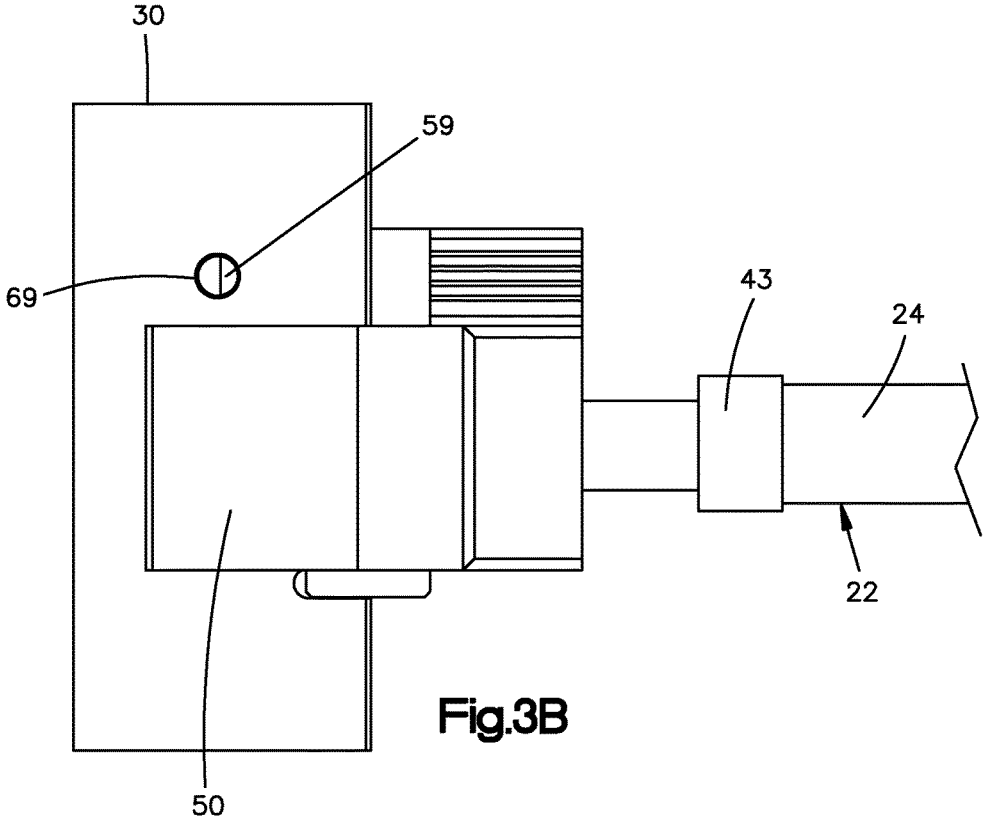
FIG. 3B is a side elevation view of a portion of the electrical assembly illustrated in FIG. 3A.

It should be appreciated that the electrical cable assembly 22 can include a single cable 24 as illustrated in FIGS. 3A-4J, or a plurality of cables 24 whose respective mating members 26 are supported by the same housing 50. For instance, as illustrated in FIGS. 1-2M, the electrical cable assembly 22 can include first and second mating members 26, first and second mounting members 28, and first and second electrical cables 24 whose first and second ends 24*a* and 24*b* are attached to the respective first and second mating members 26 and the respective first and second mounting members 28 in the manner described above. The housing 50 can be configured to receive both the first and second mating members 26, and can include first and second housing receptacles 77 that are configured to be aligned with the receptacles 42 of the first and second mating members 26 so as to receive first and second power rails 31, respectively.

Referring now to FIGS. 5A-5E, the housing 50 defines at least one channel 62, such as a plurality of channels 62, that extends therethrough along the longitudinal direction L. In accordance with one embodiment, first and second ones of the channels 62 can be spaced from each other along the lateral direction A. The channel 62 is sized and configured to receive the mating member 26 that is inserted into the channel 62 in a forward direction, which is along the longitudinal direction L. The forward direction is opposite the rearward direction. Thus, it can be said that the arms 44 extend in the forward direction with respect to the contact member 37. The mating member 26 includes at least one latch arm 60 that is configured to interfere with the housing 50 after the mating member 26 has been inserted into the channel 62 of the housing 50, so as to prevent removal of the mating member 26 from the housing 50 in the rearward direction. It should be appreciated that the first ends 24*a* of multiple electrical conductors can be shaped together in the manner described above so as to define the solidified shape 36 having the keyed surface 34.

The latch arm 60 can be elongate along a direction that includes 1) a first directional component in the rearward direction, and 2) a second directional component in an direction perpendicular to the rearward direction. The direction perpendicular to the rearward direction can be along the transverse direction T. Thus, the latch arm 60 can be oblique to both the longitudinal direction L and the transverse direction T. In accordance with one embodiment, the mating member 26 can include first and second latch arms 60 that are spaced from each other along the transverse direction T and are both configured to interfere with the housing 50 after the mating member 26 has been inserted into the channel 62 of the housing 50, so as to prevent removal of the mating member 26 from the housing 50 in the rearward direction. For instance, the latch arms 60 can extend out from the at least one shroud 46, which can include first and second shrouds 46*a* and 46*b*. In particular, the at least one shroud 46 can include a base 47, such that the shroud arms 48*a-b* extend out from the base 47 in the forward direction. The arms 44 can extend through the base 47. The latch arms 60 can extend out from the base 47. For instance, a first one of the latch arms 60 can extend out from an upper surface of the base 47, and a second one of the latch arms 60 can extend out from a lower surface of the base 47. The second directional component of the first one of the latch arms 60 can be in the upward direction. The second directional component of the first one of the latch arms 60 can be in the downward direction. The latch arms 60 can be monolithic with the shroud 46. Alternatively or additionally, the latch arms 60 can extend out from one or both of the first and second arms 44. The latch arms 60 can further be monolithic with the at least one of the first and second arms 44. The latch arms 60 can be flexible, for instance elastically flexible.

The housing 50 can define one or more pockets sized to receive respective ones of the latch arms 60. The housing 50 can further define a retention wall 65 that at least partially defines the pockets. The retention wall 65 can define the retention surface 73. Thus, as the mating member 26 is inserted into the channel 62, the latch arms 60 compresses and rides along the housing until the latch arms 60 are aligned with the pocket, at which point the latch arms 60 decompress and are inserted into the pocket. Interference between the latch arms 60 and the respective retention wall 65 prevents removal of the mating member 26 from the channel 62 along the rearward direction.

Referring now to FIGS. 5A-5E, it should be appreciated that the first ends 24*a* of multiple electrical conductors can be shaped together in the manner described above so as to define the solidified shape 36 having the keyed surface 34. Thus, it can be said that the solidified shapes 36, and thus the keyed surface 34, can be defined by at least one electrical cable 24, including a plurality of electrical cables 24. The shaped first end 24*a* defines a first centerline with respect to a lateral direction A that is perpendicular to both the forward direction and the upward direction. The contact member 37 defines a second centerline with respect to the lateral direction A. The first and second centerlines are offset from each other along the lateral direction. When the electrical cable assembly 22 includes first and second electrical cables 24 that define respective first and second solidified shapes 36 at the respective first ends 24*a*, the respective first centerlines of the solidified shapes 36 can be offset from the second centerlines along a direction away from the other one of the solidified shapes. Alternatively, the respective first centerlines of the solidified shapes 36 can be offset from the second centerlines along a direction toward the other one of the solidified shapes A method can be provided for constructing the electrical cable assembly 22 as described above. The method can include the steps of shaping the fibers of wire of the at least one of the first and second ends 24*a* and 24*b* of the electrical cable 20 so as to define at least one keyed surface 34, and, after the shaping step, fusing the fibers of wire of the at least one of the first and second ends 24*a* and 24*b* to each other so as to define the solidified shape having the at least one keyed surface 34. The fusing step can be performed prior to electrically connecting the respective at least one of the first and second ends to the mating member 26 or the mounting member 28, respectively. It should be appreciated that the method can include any one or more steps so as to construct the electrical cable assembly 22 as described herein.

Referring now to FIGS. 6A-6I, the mating member 26 can include first and second electrical conductors 41*a* and 41*b* that in turn define respective first and second arms 44*a* and 44*b*. The first and second electrical conductors 41*a* and 41*b* can further define first and second respective auxiliary walls 45*a* and 45*b* that are disposed outboard from the corresponding first and second arms 44*a* and 44*b*, respectively. Thus, when the first and second electrical conductors 41*a* and 41*b* are disposed adjacent each other along the lateral direction A, the first and second arms 44*a* and 44*b* are disposed between the first and second auxiliary walls 45*a* and 45*b*. The auxiliary walls 45*a* and 45*b* can be aligned with the respective first and second arms 44*a* and 44*b* with respect to the lateral direction A. The auxiliary walls 45*a* and 45*b* can contact the shroud 46 so as to locate the shroud 46 at a predetermined location with respect to the first and second arms 44*a* and 44*b*.

As described above, the mating member 26, can include at least one electrically conductive contact member 37 that defines at least one contact surface 38. For instance, the first and second electrical conductors 41*a* and 41*b* can include respective first and second electrically conductive contact members 37*a* and 37*b*. The first and second electrically conductive contact members 37*a* and 37*b* can be disposed adjacent each other along the lateral direction A and abut each other. Furthermore, each of the first and second electrical conductors 41*a* and 41*b* can include an attachment member at the respective first and second electrically conductive contact members 37*a* and 37*b*. The attachment member of the first electrical conductor 41*a* can be configured to attach to the attachment member of the second electrical conductor 41*b* so as to attach the first electrical conductor 41*a* to the second electrical conductor 41*b*.

Figure 6A:
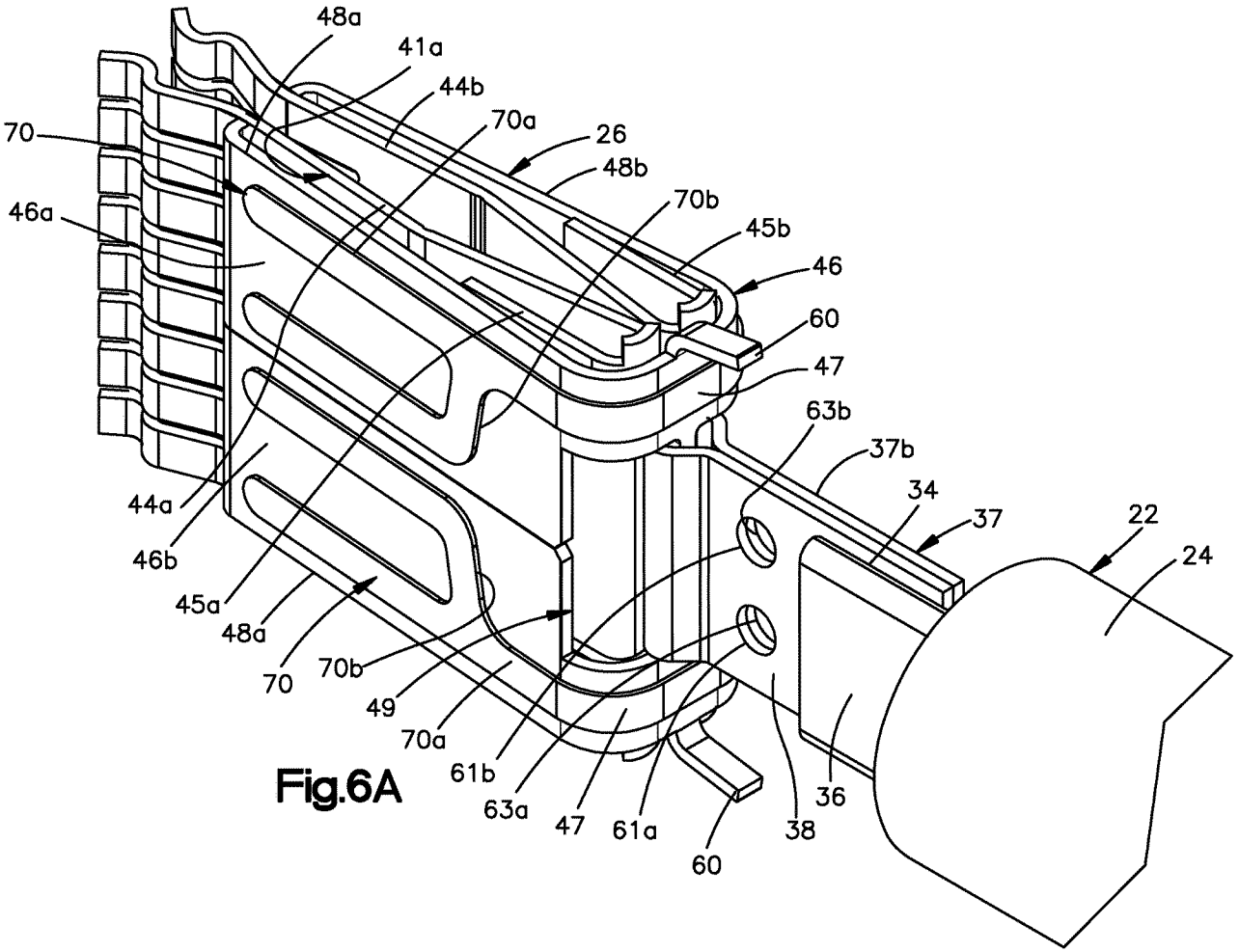
FIG. 6A is a perspective view of a portion of the electrical cable assembly, but constructed in accordance with an alternative embodiment.

For instance, as illustrated in FIG. 6A, the attachment member of the first electrical conductor 41*a* can be configured as at least one aperture 61 that extends through the first electrically conductive contact member 37*a* along the lateral direction. The attachment member can further be configured as first and second apertures 61*a* and 61*b* that extend through the first electrically conductive contact member 37*a* along the lateral direction A. Similarly, the attachment member of the second electrical conductor 41*b* can be configured as at least one aperture 63 that extends through the second electrically conductive contact member 37*b* along the lateral direction. The attachment can further be configured as first and second apertures 63*a* and 63*b* that extend through the second electrically conductive contact member 37*b* along the lateral direction A. Each of the at least one apertures 61 and 63 can be configured to receive a dowel that attaches the first electrically conductive contact member 37*a* to the second electrically conductive contact member 37*b*.

Figure 6C:
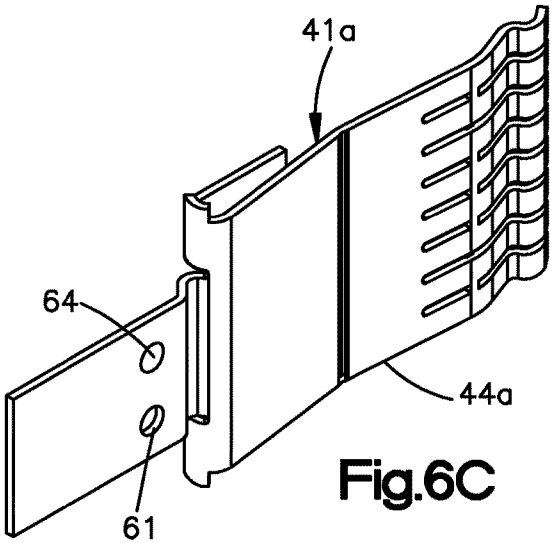
FIG. 6C is a perspective view of one of the electrical conductors of the electrical cable assembly illustrated in FIG. 6B.
Figure 6B:
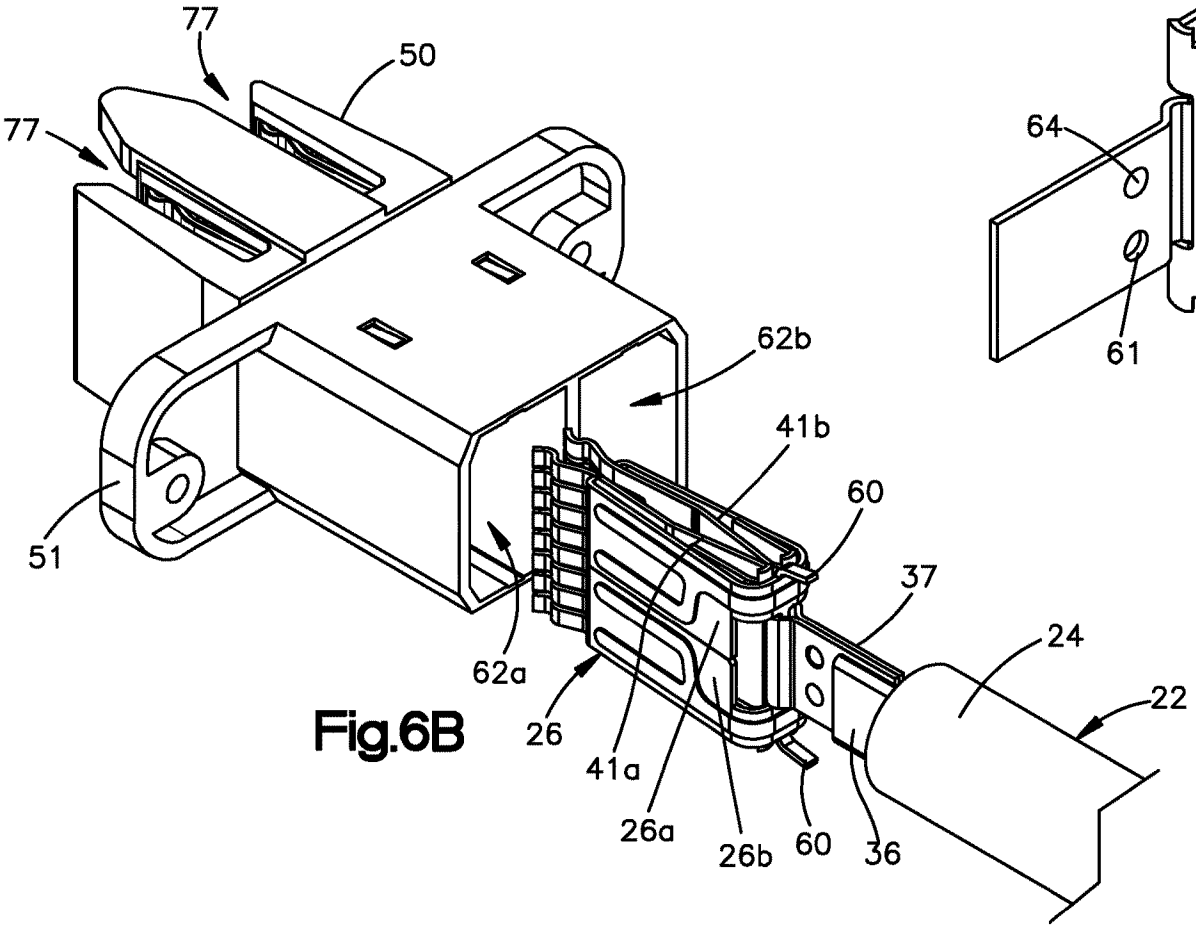
FIG. 6B is another perspective view of the portion of the electrical cable assembly illustrated in FIG. 6A.
Figure 6D:
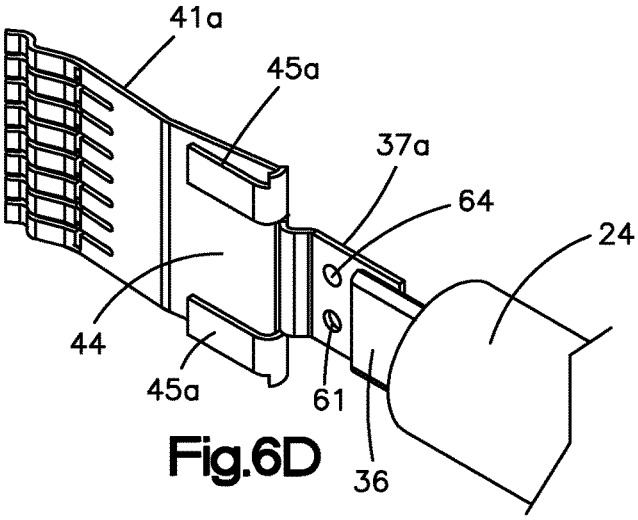
FIG. 6D is a perspective of a portion of the electrical cable assembly illustrated in FIG. 6A, showing a step of assembling the electrical cable assembly.
Figure 6E:
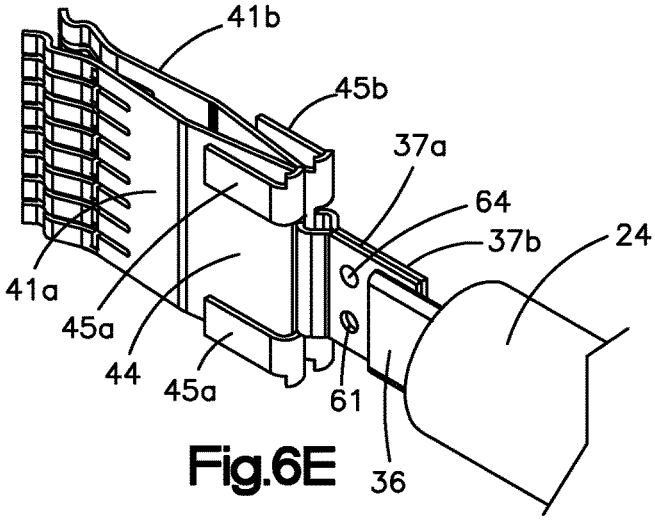
FIG. 6E is a perspective view of a portion of the electrical cable assembly illustrated in FIG. 6A, showing another step of assembling the electrical cable assembly.
Figure 6F:
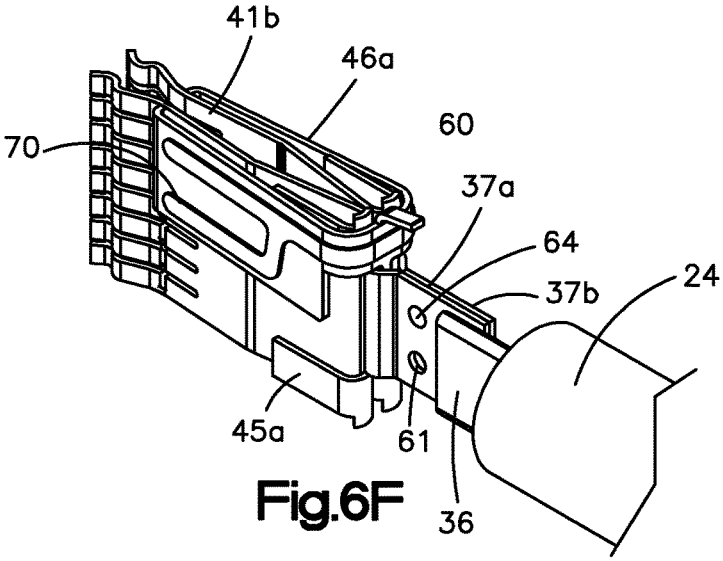
FIG. 6F is a perspective view of a portion of the electrical cable assembly illustrated in FIG. 6A, showing another step of assembling the electrical cable assembly.
Figure 6G:
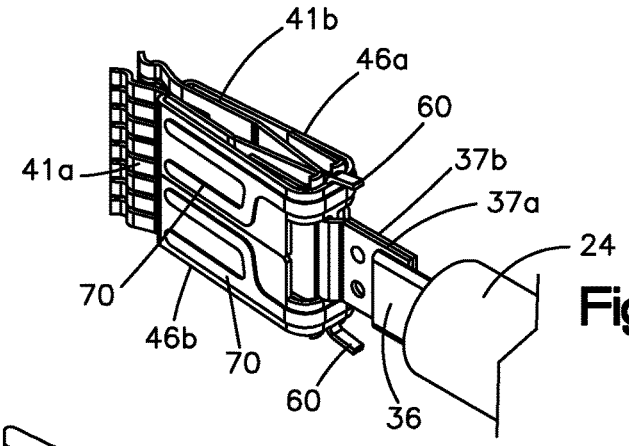
FIG. 6G is a perspective view of a portion of the electrical cable assembly illustrated in FIG. 6A, showing yet another step of assembling the electrical cable assembly.
Figure 6H:
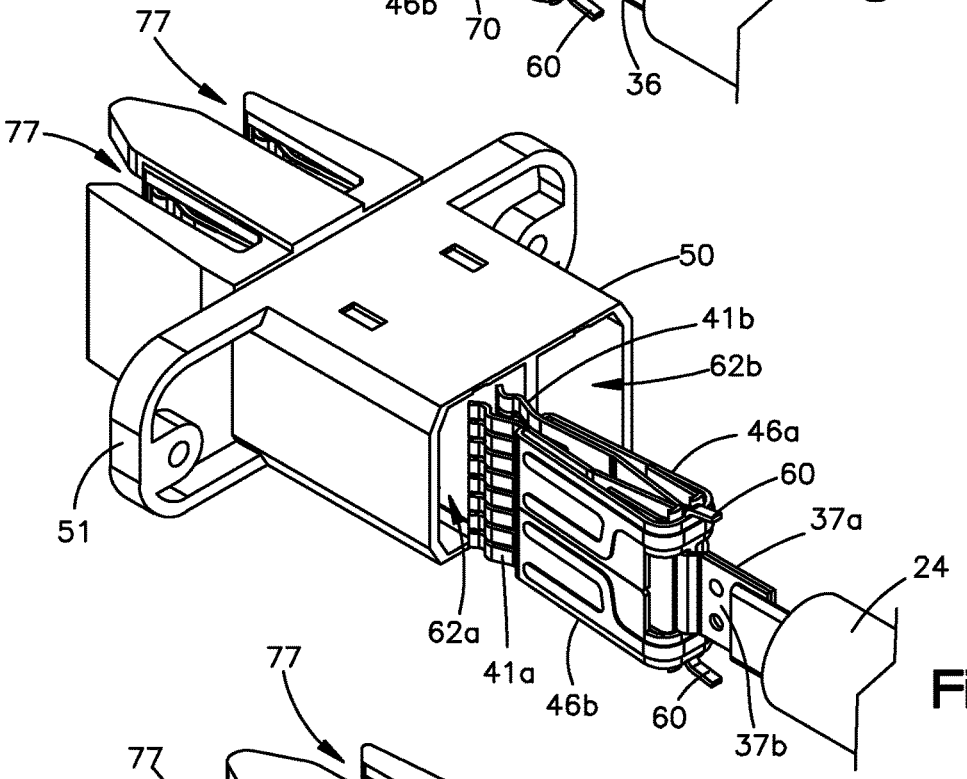
FIG. 6H is a perspective view of a portion of the electrical cable assembly illustrated in FIG. 6A, showing still another step of assembling the electrical cable assembly.
Figure 6I:
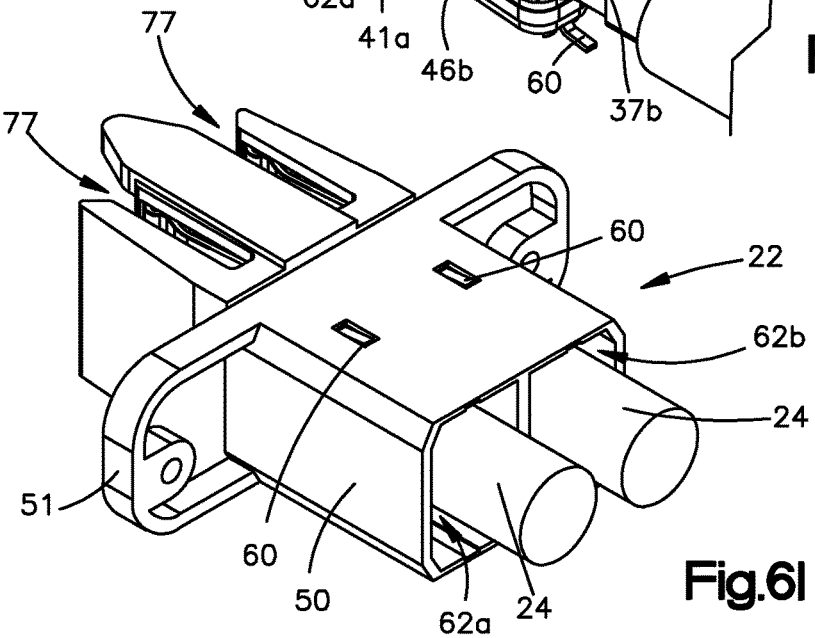
FIG. 6I is a perspective view of a portion of the electrical cable assembly illustrated in FIG. 6A, showing still another step of assembling the electrical cable assembly.
Figure 7C:
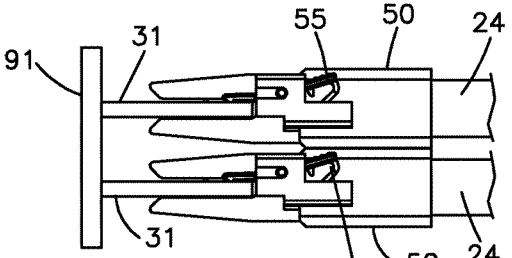
FIG. 7C is a top view of the electrical assembly illustrated in FIG. 7A.
Figure 7D:
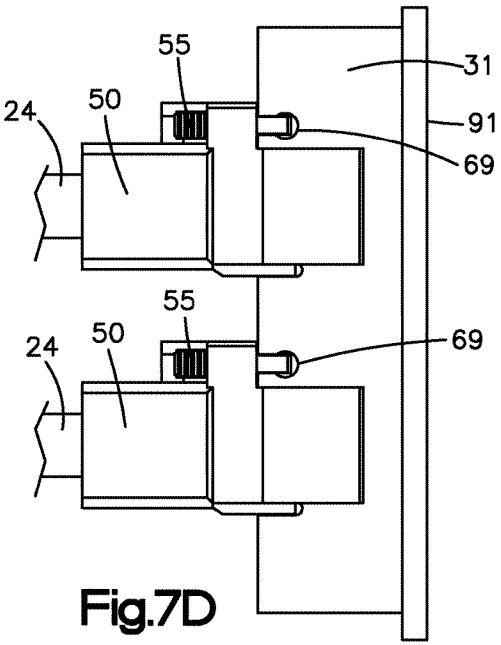
FIG. 7D is a side view of the electrical assembly illustrated in FIG. 7A.
Figure 7B:
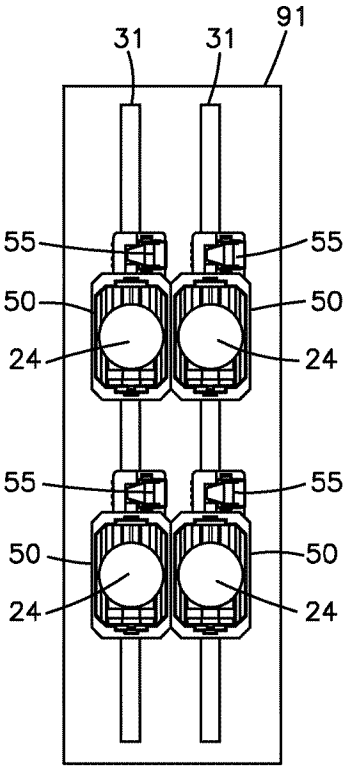
FIG. 7B is a rear view of the electrical assembly illustrated in FIG. 7A.
Figure 7A:
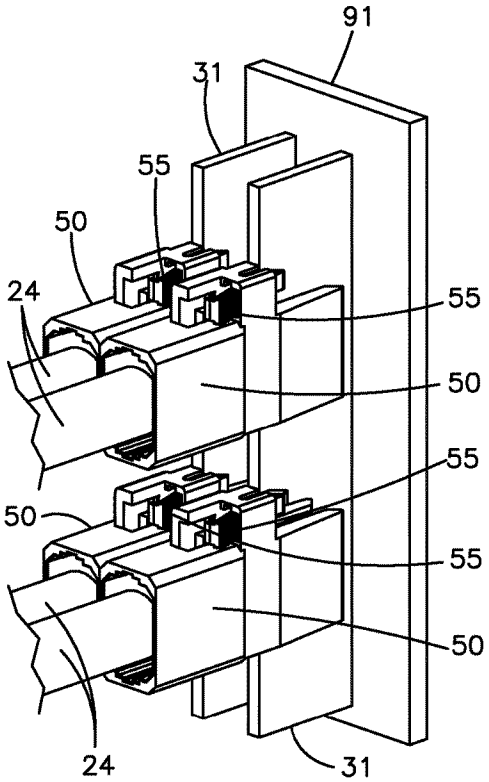
FIG. 7A is a perspective view of the electrical assembly as illustrated in FIG. 1, but constructed in accordance with another embodiment.
Figure 7E:
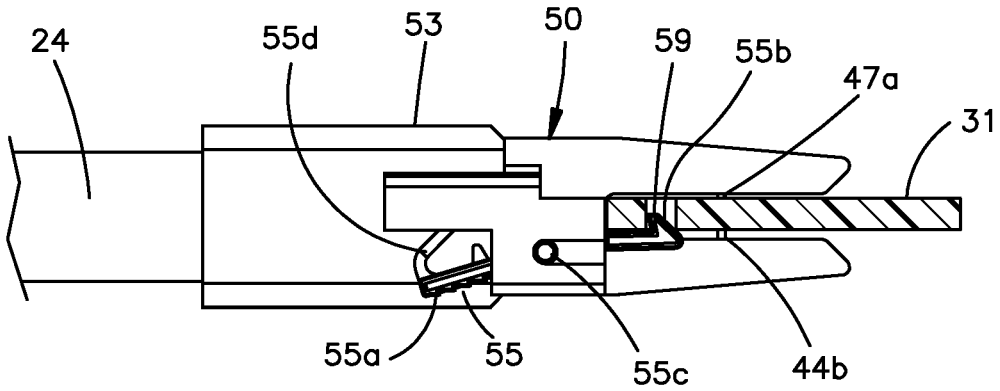
FIG. 7E is an enlarged top view of an the electrical assembly illustrated in FIG. 7A.
Figure 7F:
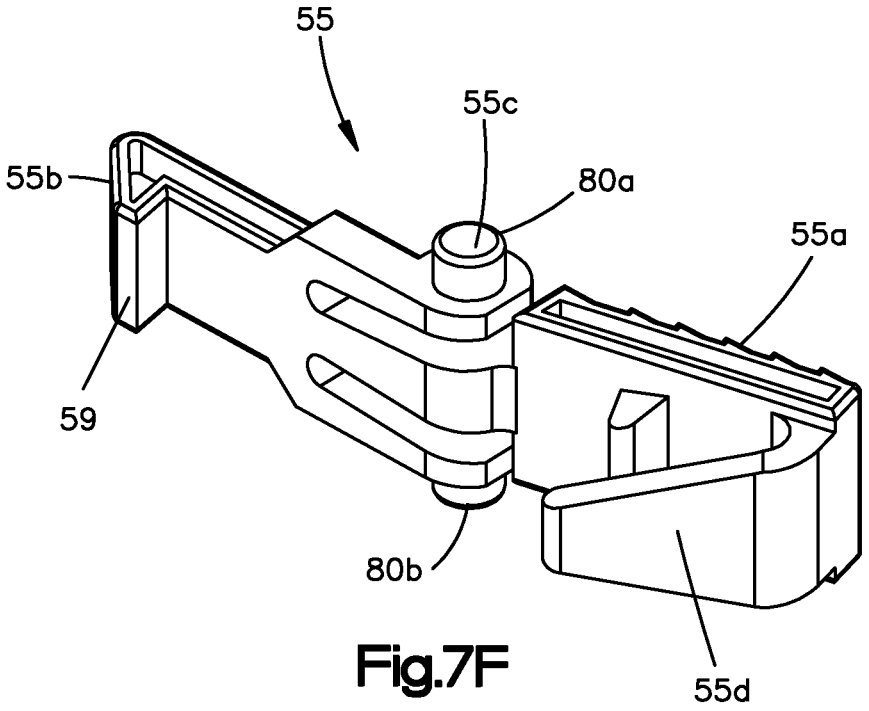
FIG. 7F is a perspective view of a latch member of the electrical assembly illustrated in FIG. 7A.
Figure 7H:
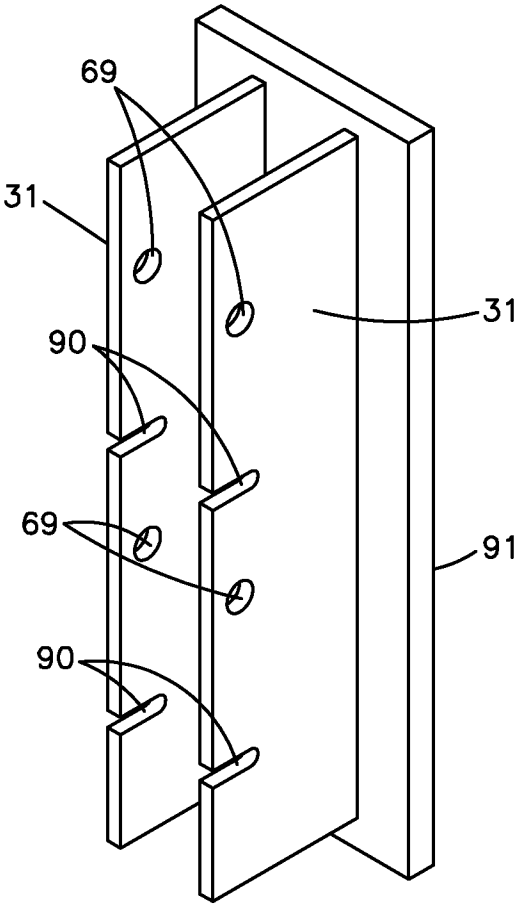
FIG. 7H is a perspective view of first and second power rails of the electrical assembly illustrated in FIG. 7A shown mounted to a complementary power bus.
Figure 7G:
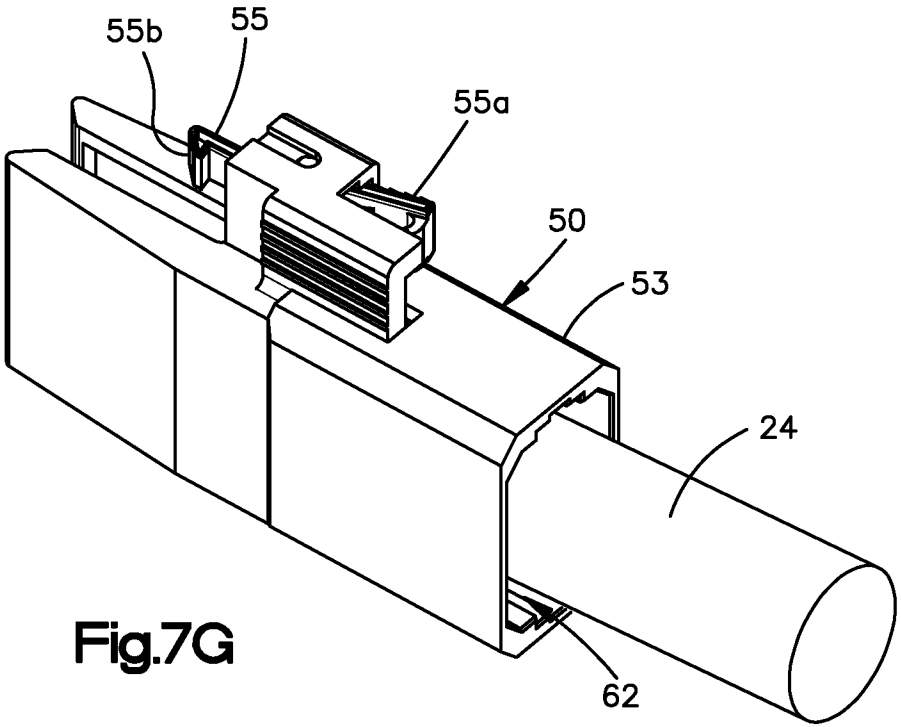
FIG. 7G is a perspective view of an electrical cable assembly of the electrical assembly illustrated in FIG. 7A.
Figure 7I:
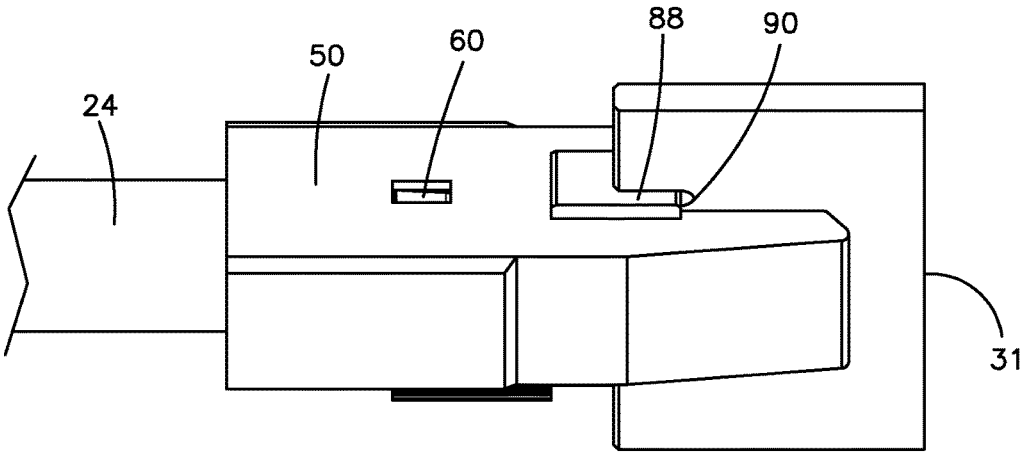
FIG. 7I is an enlarged bottom perspective view showing an electrical cable assembly mated with a power rail of the electrical assembly illustrated in FIG. 7A.
Figure 7J:
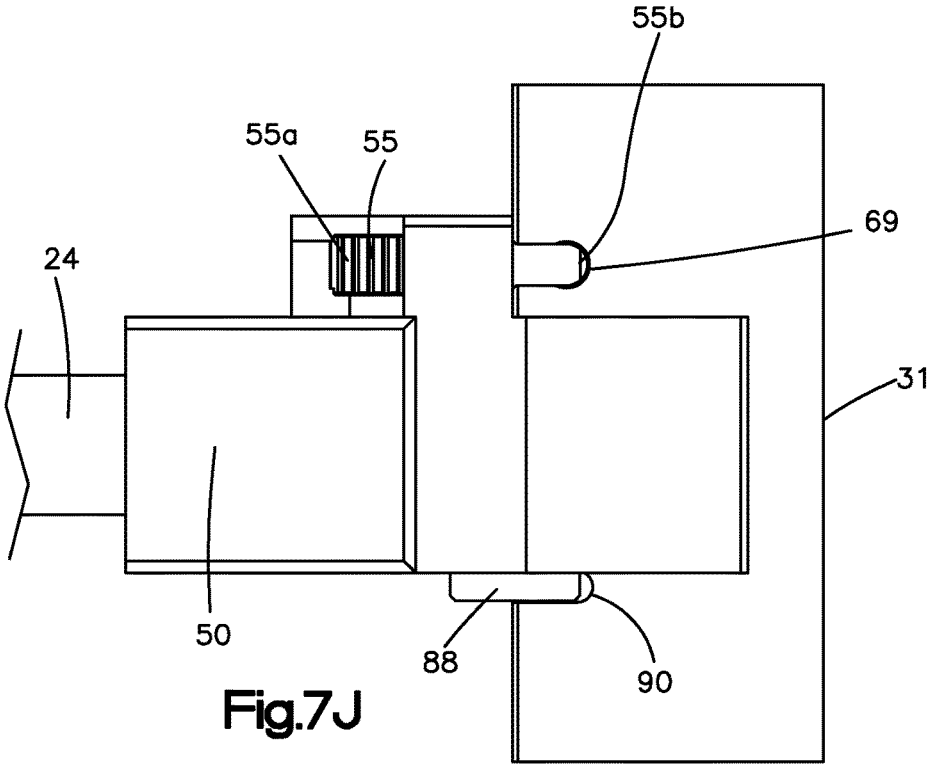
FIG. 7J is a side elevation view of the electrical cable assembly mated with a power rail of the electrical assembly illustrated in FIG. 7A.

Alternatively, as illustrated in FIGS. 6B-6C, at least one of the attachment members of one of the first and second electrically conductive contact member 37*a* and 37*b* can be configured as a projection 64, and at least one of the attachment members of the other of the first and second electrically conductive contact member 37*a* and 37*b* can be configured as an aperture sized to receive the projection 64. For instance, the projection 64 can be configured as an embossment in the at least one of the first and second electrically conductive contact member 37*a* and 37*b*. For instance, each of the first and second electrically conductive contact member 37*a* and 37*b* can define a projection 64, and each of the first and second electrically conductive contact member 37*a* and 37*b* can define an aperture that is configured to receive the projection 64 of the other of the first and second electrically conductive contact member 37*a* and 37*b* so as to attach the first and second electrically conductive contact member 37*a* and 37*b* to each other. When the first and second electrically conductive contact member 37*a* and 37*b* are attached to each other, or positioned adjacent each other so as to define the receptacle 40, the receptacle 42 is configured to receive the first complementary electrical device 30 so as to place the first complementary electrical device in electrical communication with the mating member 26. The receptacle 42 can be defined by deflectable fingers of each of the first and second arms 44*a* and 44*b*.

With continuing reference to FIGS. 6A-6I, the shroud 46 can include first and second shroud members 46*a* and 46*b* that can be symmetrical with respect to each other. For instance, each of the first and second shroud members 46*a* and 46*b* can define a first shroud arm 48*a*, a second shroud arm 48*b*, and a base 47 that extends between the first and second shroud arms 48*a* and 48*b*, such that the first and second shroud arms 48*a* and 48*b* are spaced from each other in the lateral direction A. The first and second shroud members 46*a* and 46*b* can be positioned adjacent each other along the transverse direction T. For instance, the first and second shroud members 46*a* and 46*b* can abut each other along the transverse direction. The base 47 of each of the first and second shroud members 46*a* and 46*b* can define outer surfaces that face away from each other, such that the respective first and second latch arms 60 extend out from the outer surface of the base 47 of the first and second shroud members 46*a* and 46*b*, respectively. Each of the first and second shroud members 46*a* and 46*b* can define a gap. When the first and second shroud members 46*a* and 46*b* are disposed adjacent each other, the gaps of the first and second shroud members 46*a* and 46*b* cooperate to define an aperture 49 that is configured to receive the respective first and second electrical conductors 41*a* and 41*b*. For instance, the first and second contact members 37*a* and 37*b* are configured to extend through the aperture 49 when the shroud 46 is mounted on the electrical conductors 41*a* and 41*b* such that the shroud arms 48*a* and 48*b* abut respective outer surfaces of the first and second arms 44*a* and 44*b*, respectively. For instance, rearward most edges of the first and second shroud arms 48*a* and 48*b* of each of the first and second shroud members can be spaced from each other along the lateral direction A so as to further partially define the gap. The gap can be further partially defined by the respective base 47. Thus, the bases 47 of the first and second shroud member 46*a* and 46*b* can be spaced from each other along the transverse direction T so as to partially define the aperture 49.

The first and second shroud arms 48*a* and 48*b* of the first and second shroud members 46*a* and 46*b* can define respective inner surfaces that face each other along the lateral direction A, and outer surfaces that face away from each other along the lateral direction A. At least one or both of the first and second shroud arms 48*a* and 48*b* of at least one or both of the first and second shroud members 46*a* and 46*b* can define respective ribs 70 that project out from the respective outer surfaces. The ribs 70 can define a first portion 70*a* that extends substantially along the longitudinal direction L, and a second portion 70*b* that is rearward of the first portion 70*a* with respect to the longitudinal direction L that extends from the first portion 70*a* along a direction that includes a directional component in the transverse direction T. For instance, the second portion 70*b* of the ribs 70 of the first shroud member 46*a* can extend away from the second shroud member 46*b* along the transverse direction. Similarly, the second portion 70*b* of the ribs 70 of the second shroud member 46*b* can extend away from the first shroud member 46*a* along the transverse direction T. The ribs 70 are configured to be received by a window cut-out in the housing 50 when the shroud 46 is inserted in the housing 50.

Referring now to FIGS. 6D-6I, a method for fabricating the cable assembly 22 can include the step of attaching the at least one keyed surface 34 of the solidified shape 36 to the electrically conductive contact member 37 of one of the first and second electrical conductors 41*a* and 41*b*. For instance, the keyed surface 34 can be welded to the electrically conductive contact member 37 in the manner described above. In accordance with the illustrated embodiment, the keyed surface 34 is welded to the electrically conductive contact member 37*a* of the first electrical conductor 41*a*, though it should be appreciated that the keyed surface 34 can be welded to the electrically conductive contact member 37*b* of the second electrical conductor 41*b*. Next, the first and second electrical conductors 41*a* and 41*b* can be attached to each other as described above. Next, the first shroud member 46*a* can be placed over an upper portion of the first and second arms 44*a* and 44*b* in the manner described above. Next, the second shroud member 46*b* can be placed over a lower portion of the first and second arms 44*a* and 44*b* in the manner described above, such that the a portion of each of the first and second electrical conductors 41*a* and 41*b* extends through the aperture 49. Next, a first one 26*a* of the mating members 26 can be inserted in the forward longitudinal direction L into a first one 26*a* of the channels 62 of the housing 50. The latch arm 60 of the first one 26*a* of the mating members 26 can attach to the housing 50 in the manner described above. The above-described steps can be repeated so as to fabricate a second one of the mating members 26 that can be inserted in the forward longitudinal direction L into the second one 62*b* of the channels 62 of the housing 50, such that the latch arm 60 of the second one of the mating members attaches to the housing 50. The second channel 62*b* can be spaced from the first channel 62*a* in the lateral direction A.

Figure 4A:
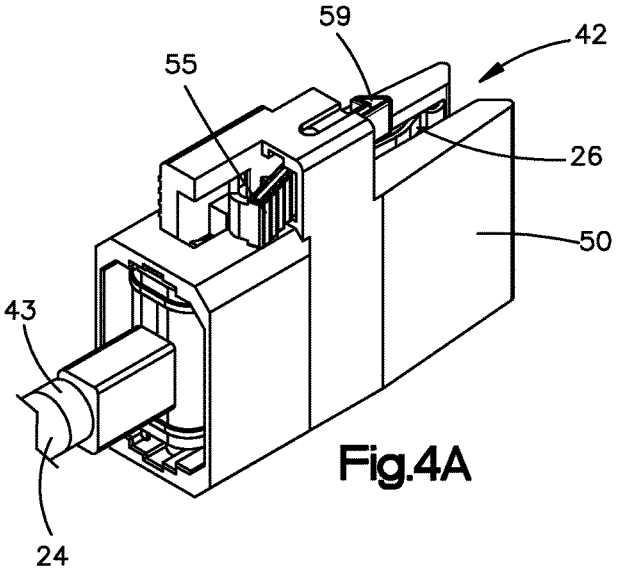
FIG. 4A is a perspective view of a portion of the electrical assembly illustrated in FIG. 3A.
Figure 4B:
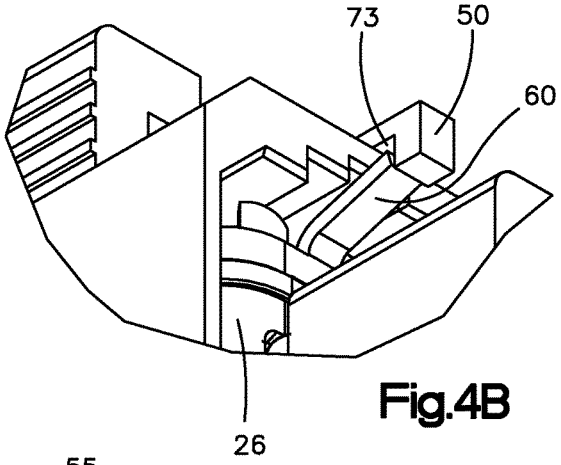
FIG. 4B is a perspective view of a portion of the electrical assembly illustrated in FIG. 3A.
Figure 4C:
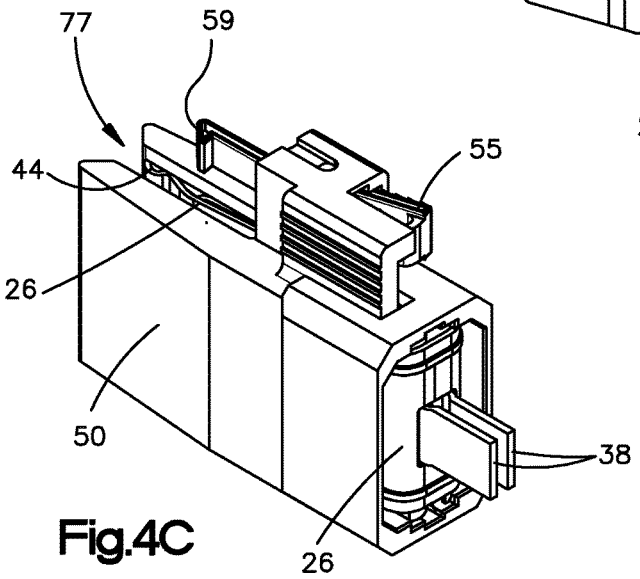
FIG. 4C is a perspective view of the housing of the electrical assembly illustrated in FIG. 3A.
Figure 4F:
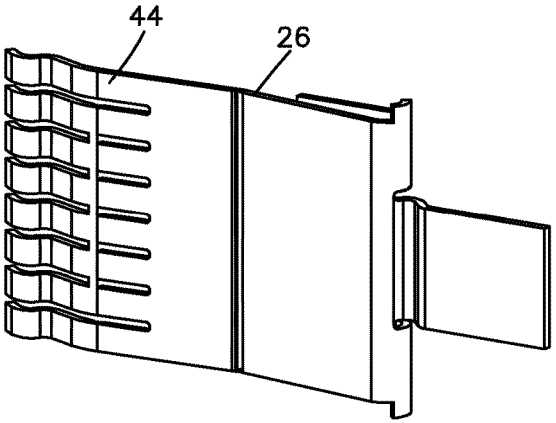
FIG. 4F is a perspective view of a portion of the contact member of the electrical assembly illustrated in FIG. 3A.
Figure 4G:
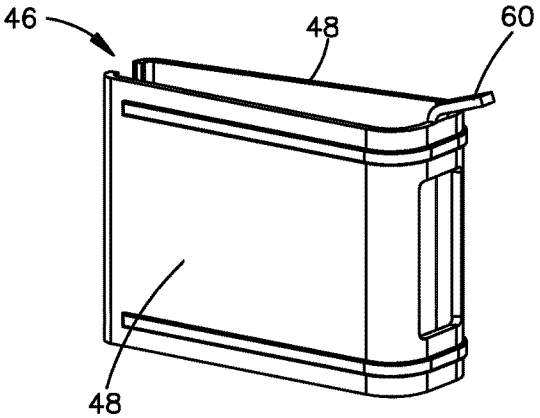
FIG. 4G is a perspective view of the shroud of the electrical assembly illustrated in FIG. 3A.
Figure 4D:
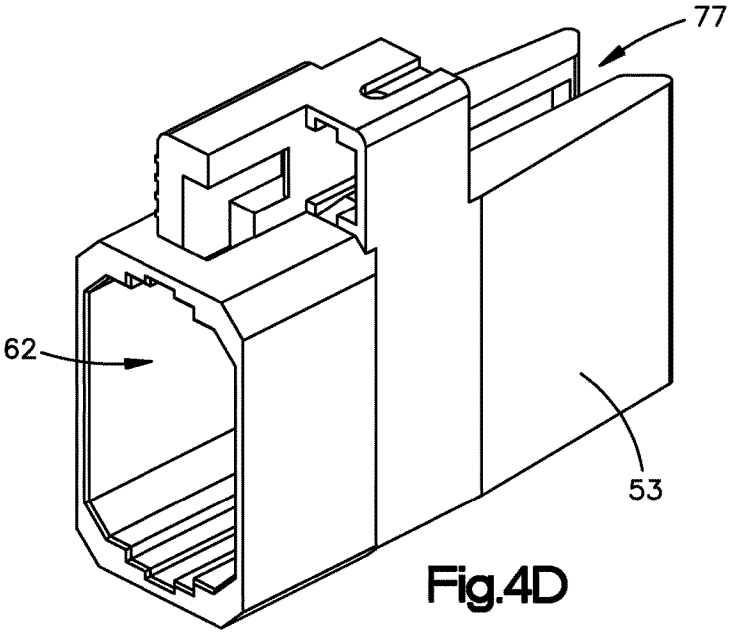
FIG. 4D is a perspective view of a portion of the housing illustrated in FIG. 4C.
Figure 4E:
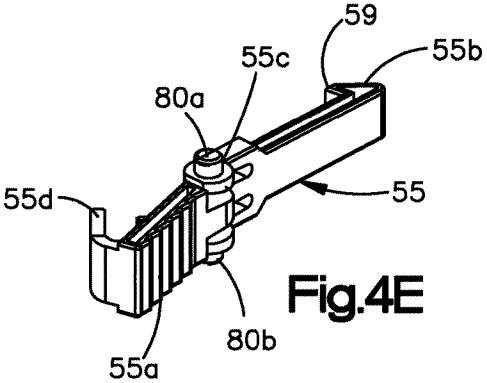
FIG. 4E is a perspective view of a latch the housing illustrated in FIG. 4D.
Figure 4H:
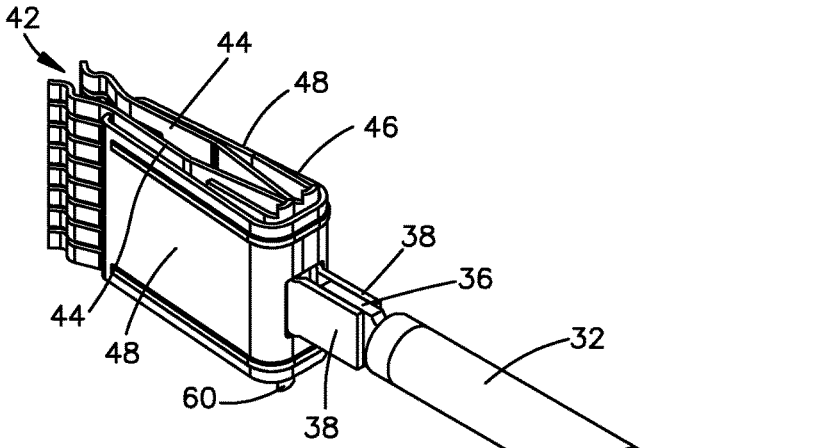
FIG. 4H is a perspective view of a portion of the electrical cable assembly illustrated in FIG. 3A, showing a step of assembling the electrical cable assembly.
Figure 4I:
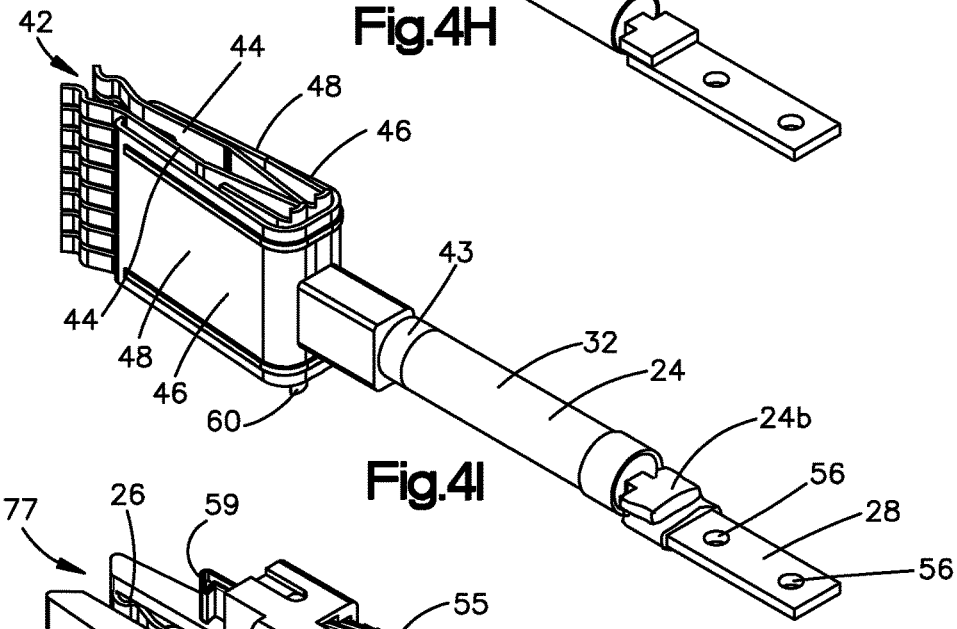
FIG. 4I is a perspective view of a portion of the electrical cable assembly illustrated in FIG. 3A, showing another step of assembling the electrical cable assembly.
Figure 4J:
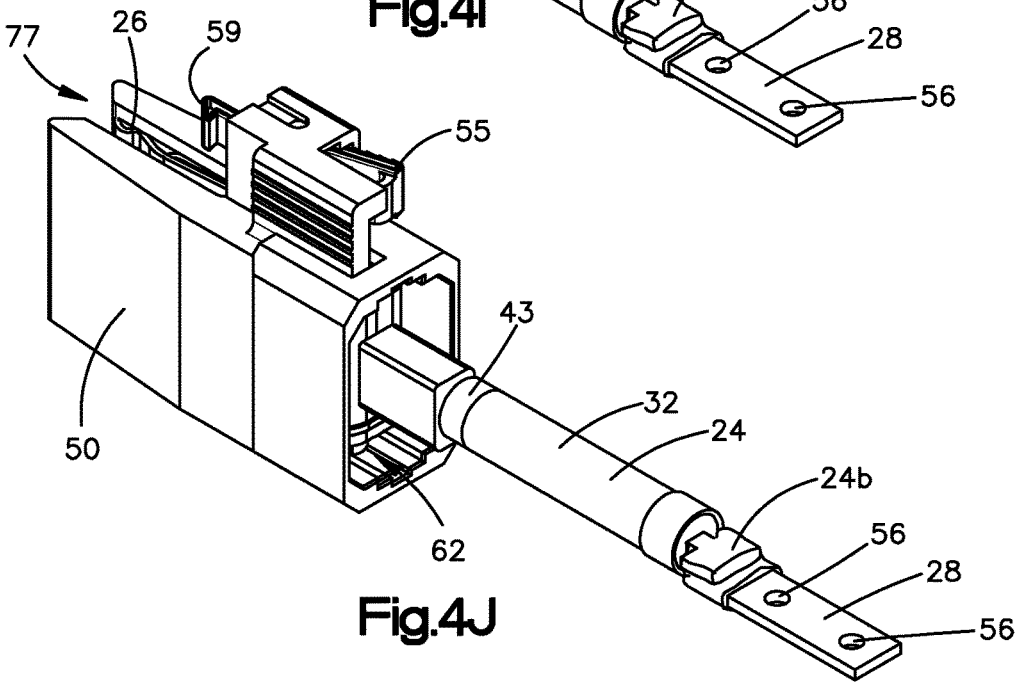
FIG. 4J is a perspective view of a portion of the electrical cable assembly illustrated in FIG. 3A, showing yet another step of assembling the electrical cable assembly.
Figure 5A:
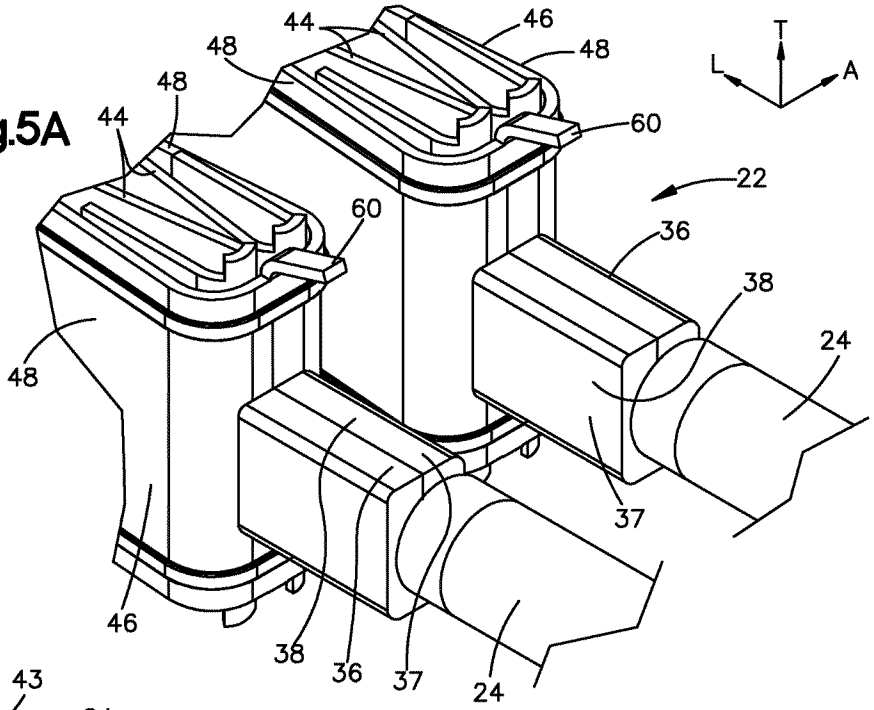
FIG. 5A is a perspective view of a portion of the electrical cable assembly.
Figure 5B:
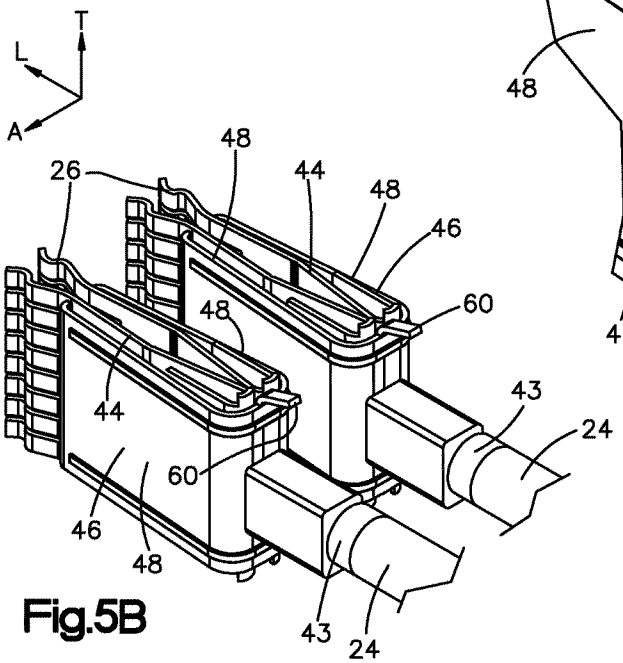
FIG. 5B is another perspective view of a portion of the electrical cable assembly illustrated in FIG. 5A.
Figure 5C:
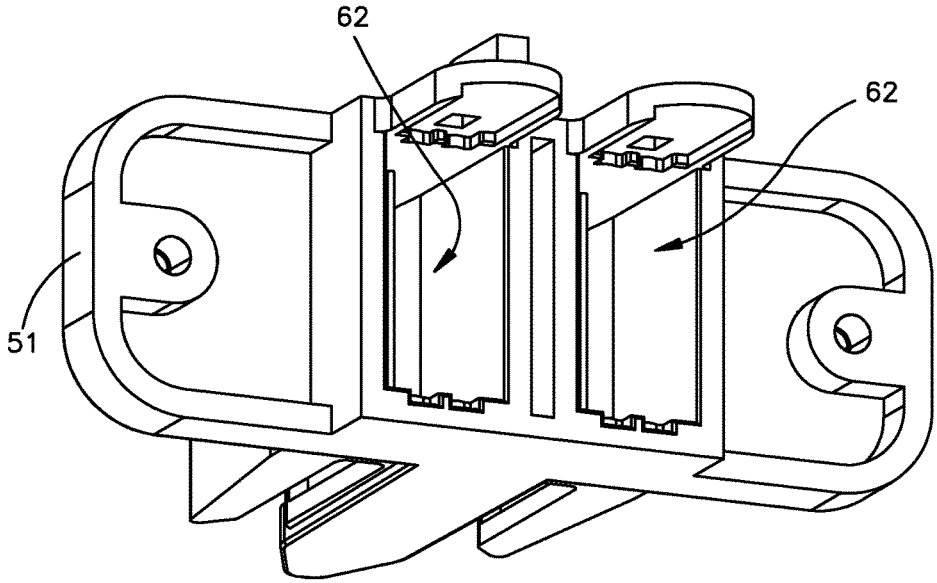
FIG. 5C is a perspective view of a housing of the electrical cable assembly illustrated in FIGS. 5A-B.
Figure 5D:
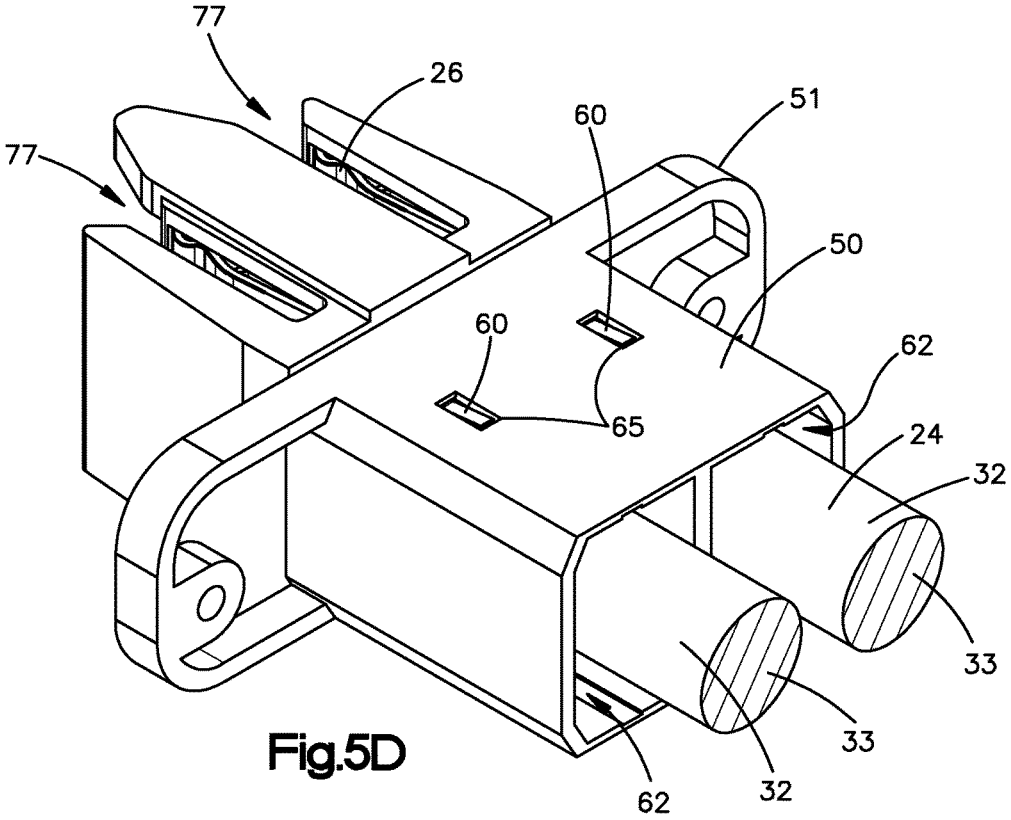
FIG. 5D is a perspective view of an electrical assembly including the electrical cable assembly illustrated in FIGS. 5A-C and first and second complementary electrical devices.
Figure 5E:
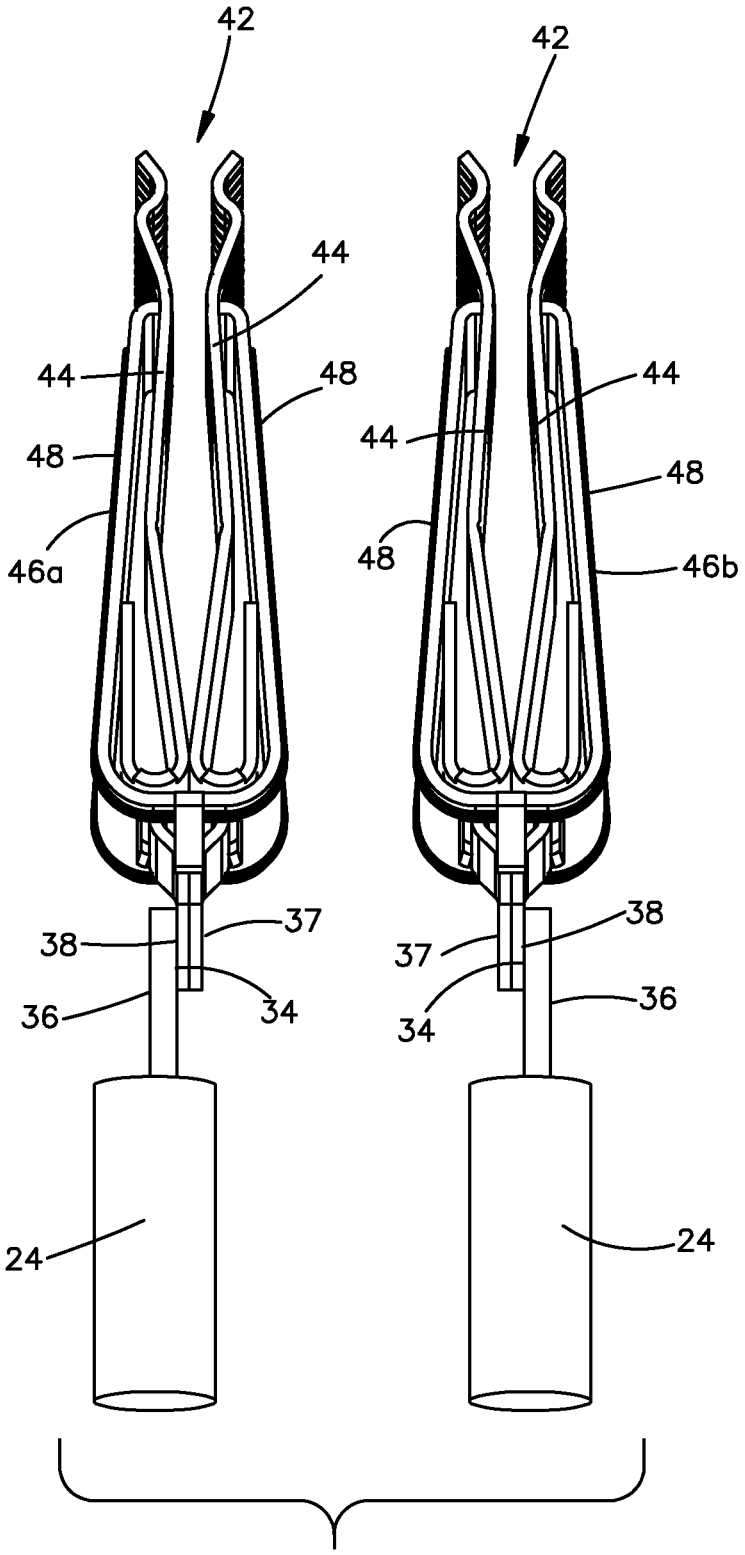
FIG. 5E is a top plan view of the electrical cable assembly illustrated in FIGS. 5A-C.

Referring now to FIG. 7A-7J, the electrical cable assemblies 22 in accordance with any embodiment described above can further include the latch 55 (see FIGS. 3A-4J). For instance, the connector housing 50 can include a housing body 53 and the latch 55 that is supported by the housing body 53. For instance, the latch 55 can be rotatably supported by the housing body 53 so as to rotate relative to the housing body 53 about an axis of rotation that extends in the transverse direction T. As also illustrated in FIG. 4E, the latch 55 can include a grip portion 55*a*, a head 55*b*, and a pivot location 55*c* disposed between the grip portion 55*a* and the head 55*b*. The head 55*b* can carry the projection 59 described above. For instance, the pivot location 55*c* can include at least one pivot member 80 that is configured to be received in a seat of the housing body 53 such that the pivot member 80 is rotatable with respect to the housing body 53 about the axis of rotation.

In accordance with one embodiment, the at least one pivot member 80 can include first and second pivot members 80*a* and 80*b* that are spaced from each other along the transverse direction T. Each of the first and second pivot members pivot members 80*a*-*b* that are configured to be received in respective seats of the housing body 53. The first and second pivot member 80*a* and 80*b* are spaced from each other along the transverse direction T so as to define the axis of rotation. The latch 55 can be spaced from the respective electrical conductors 41*a* and 41*b* along the transverse direction T. The latch 55 can further be spaced from the shroud 46 along the transverse direction T. For instance, the latch 55 can be disposed above the electrical conductors 41*a* and 41*b* and the shroud 46 along the transverse direction T. The head 55*b* can define an outer surface 82 that is configured to be received in an aperture 69 that extends through the respective power rail 31. For instance, the aperture 69 can extend through the power rail 31 along the lateral direction A. The aperture 69 can have any size and shape as desired. For instance, the aperture 69 can be cylindrical in shape. Similarly, the head 55*b* can have any size and shape as desired, such that the head 55*b* is sized to be received in the aperture 69 such that the head 54 is rotatable in the aperture 69. The power rails 31 can be mounted to a complementary power bus 91, which can be configured as a printed circuit board or a power rail. The power rails 31 can be oriented parallel to each other, and orthogonal to the complementary power bus 91.

The aperture 69 can extend through the power rail 31 along a central axis that extends in the lateral direction A. Further, it should be appreciated that the head 55*b* can define a central axis along the lateral direction A. Each of the central axes can be oriented substantially in the lateral direction, depending on whether play exists in the aperture 69. The central axis of the head 55*b* can be coincident with the central axis of the aperture 69. It is recognized that when the head 55*b* of the latch 55 is disposed in the aperture 69, the housing 50 can define a moment of force about an axis that extends substantially in the lateral direction A that can tend to move the housing 50 toward or away from the power rail 31 as the housing pivots about an axis. The axis can be defined by the central axis of the aperture 69, the central axis of the head 55*b*, both central axes, or another axis in the lateral direction A, for instance when the aperture 69 is sized greater than the head 55*b* such that the head 55*b* is eccentrically movable within the aperture 69. Thus, the axis can extend through the aperture 69 in the lateral direction A. The axis can further extend through the head 55*b* in the lateral direction A. For instance, the housing 50 can tend to pivot about the central axis, as the head 55*b* rotates within the aperture 69. Accordingly, the housing 50 can include an anti-rotation member 86 that can be configured as an anti-rotation wall 88. The wall 88 can be disposed such that the arms 44 and the shroud 46 are disposed between the wall 88 and the latch 55 along the transverse direction T. The power rail 31 can include a slot 90 that is sized to receive the anti-rotation wall 88. The anti-rotation wall 88 can define first and second opposed surfaces 92*a* and 92*b* that face respective opposed first and second surfaces 94*a* and 94*b* of the power rail 31 that define the slot 90. Thus, the first surface 92*a* of the anti-rotation wall 88 can contact the first surface 94*a* of the power rail 31 to prevent the housing 50 from pivoting about the central axis in a first direction. The second surface 92*b* of the anti-rotation wall 88 can contact the second surface 94*b* of the power rail to prevent the housing 50 from pivoting about the central axis in a second direction opposite the first direction. It should be appreciated that a method of preventing rotation about an axis that extends along the lateral direction A can include the step of inserting the anti-rotation wall 88 in the slot 90.

Thus, during operation, a force can be applied to the latch 55 that causes the head 55*b* to move from a first position along a direction away from the power rail 31 as the latch 55 pivots about the axis of rotation in a first direction. It should be appreciated that a force can be applied to the grip portion 55*a* that causes the latch 55 to pivot about the axis of rotation in the first direction. Alternatively, the head 55*b* can define a beveled leading surface that cams over a front edge of the power rail 31, which causes the latch member to pivot about the axis of rotation in the first direction. When the head 55*b* is aligned with the aperture 69, the latch 55 can pivot about the axis of rotation in a second direction opposite the first direction, thereby causing the head 55*b* to be inserted in the aperture 69. For instance, it should be appreciated that the latch 55 can be spring biased to return to the first position along the second direction. In particular, the latch 55 can include a spring member 55*d* that extends from the grip portion 55*a* and biases against the housing body 53 so as to provide the spring force. Alternatively, a force can be applied to the grip portion 55*a* that causes the latch 55 to pivot about the axis of rotation in the second direction. As the housing 50 and the power rail 31 are moved toward each other until the head 55*b* is aligned with the aperture, the anti-rotation wall is inserted into the slot 90. Once the head 55*b* is disposed in the aperture 69, interference between the head 54 and the power rail 31 prevents translation of the housing 50 with respect to the power rail 31. When it is desired to remove the housing 50 from the power rail 31, a force can be applied to the grip portion 55*a* that causes the latch 55 to rotate about the axis of rotation in the first direction, thereby removing the head 55*b* from the aperture 69. Once the head 55*b* has been removed from the aperture 69, the housing 50 can be removed from the power rail 31, which removes the power rail 31 from the receptacle 77.

A method can further be provided for selling the electrical cable assembly as described herein. The method can include the steps of teaching to a third party one or more up to all of the method steps described herein, and selling to the third party the electrical cable assembly 22. The method can further include the step of teaching to the third party the step of receiving the power rail 31 in the receptacle 42 of the mating member 26. The method can further include the step of teaching to the third party the step of securing the mounting member 28 to the substrate.

Figure 8A:
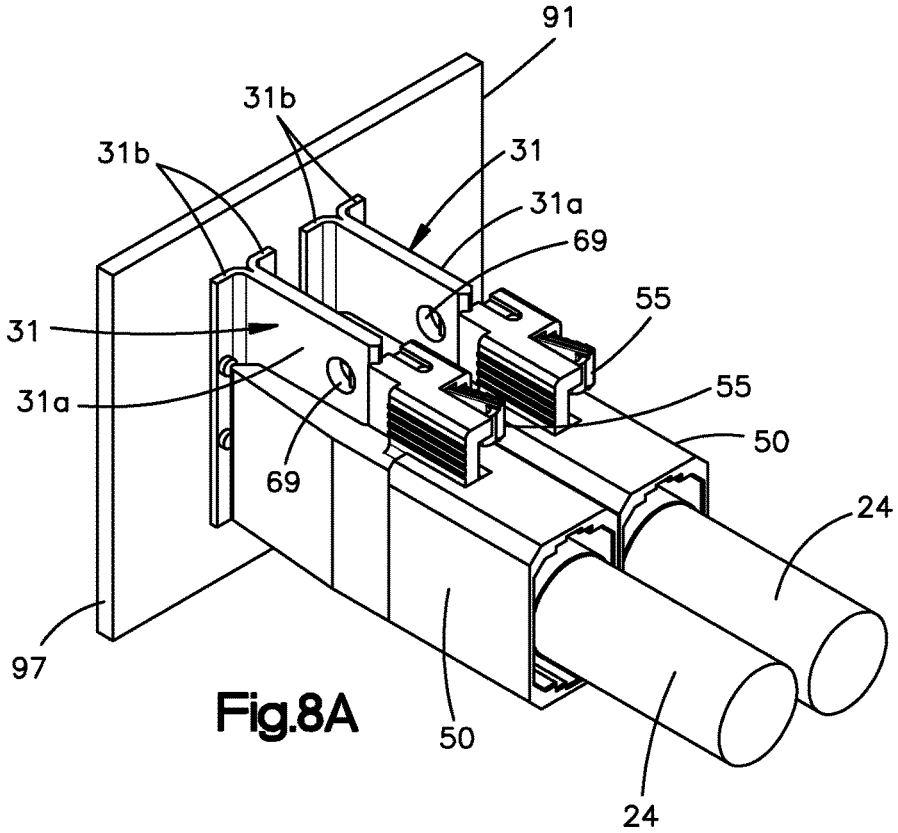
FIG. 8A is a perspective view of an electrical assembly, including a pair of power rails, a complementary power bus, and a pair of cable assemblies, wherein each of the power rails is mounted to the complementary power bus and mated a respective one of the pair of cable assemblies.
Figure 8B:
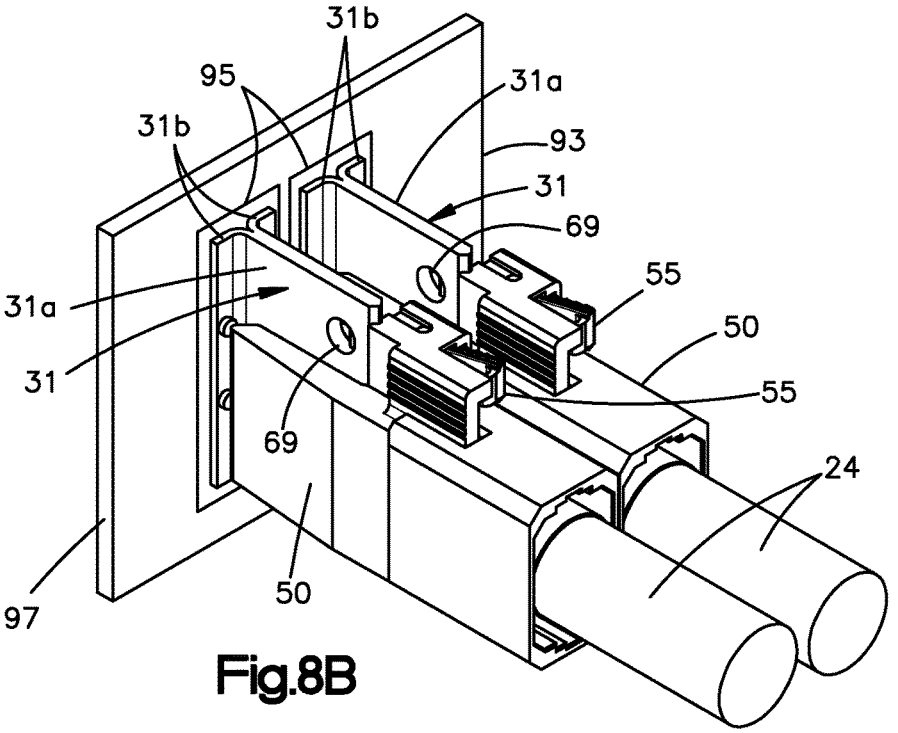
FIG. 8B is a perspective view of an electrical assembly, including a pair of power rails, a printed circuit board, and a pair of cable assemblies, wherein each of the power rails is mounted to the printed circuit board and mated a respective one of the pair of cable assemblies.
Figure 8E:
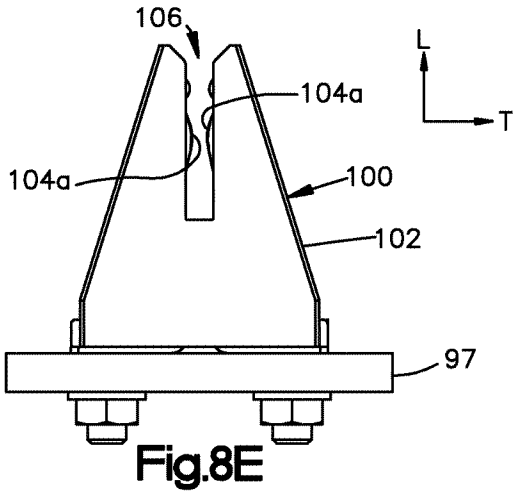
FIG. 8E is a side elevation view of the electrical connector mounted to the complimentary power bus.
Figure 8F:
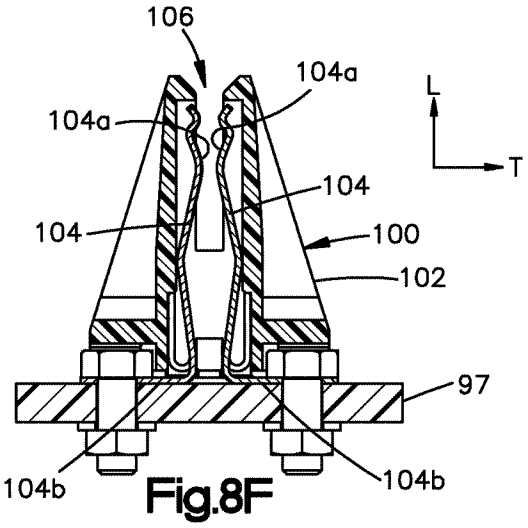
FIG. 8F is a sectional side elevation view of the electrical connector mounted to the complimentary power bus.
Figure 8C:
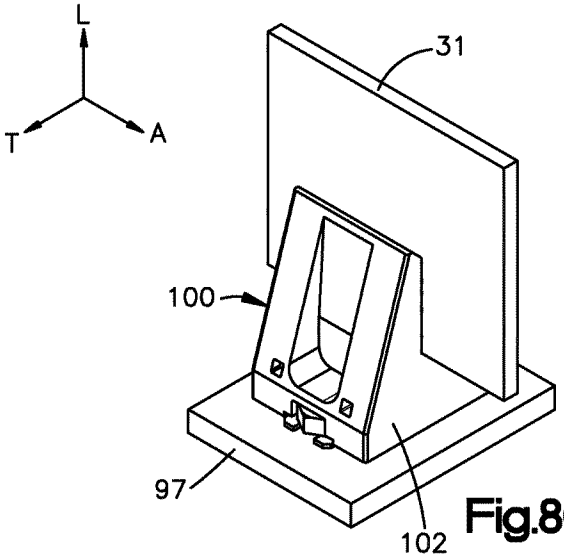
FIG. 8C is a perspective view of an electrical assembly including a power rail, a complementary power bus, and an electrical connector mated to the power rail and mounted to the complimentary power bus.
Figure 8D:
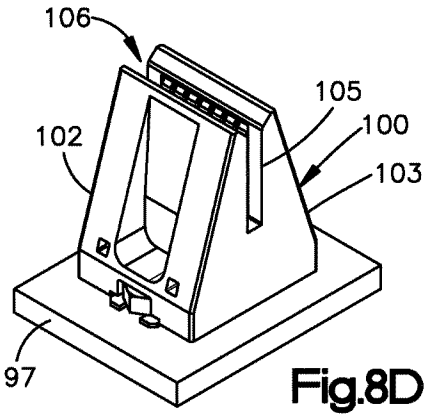
FIG. 8D is a perspective view of the electrical connector mounted to the complimentary power bus.

Referring now to FIGS. 8A-8B, and as described above with respect to FIGS. 7A-7J, the electrical assembly 20 can include at least one electrical cable assembly 22 that can be placed in electrical communication with a common electrically conductive substrate 97. The common electrically conductive substrate 97 can be configured as a complementary electrical power bus 91. In particular, the electrical assembly 20 can include at least one electrical power rail 31 that is mounted to the power bus 91. Accordingly, the at least one electrical cable assembly 22 can be mated to the respective at least one power rail 31 so as to be placed in electrical communication with the power rail 31 through the power bus 91. For instance, the electrical assembly 20 can include a plurality of electrical cable assemblies 22, including at least a pair of electrical cable assemblies 22. The electrical assembly can further include a respective plurality of power rails 31 that are configured to be mated to respective ones of the electrical cable assemblies 22 in the manner described above. Each of the respective plurality of power rails can be mounted to the common complementary electrical power bus 91, thereby placing each of the respective plurality of electrical cable assemblies 22 in electrical communication with the electrical power bus. The electrical power bus 91 can be made of any suitable electrically conductive material. Similarly, each of the electrical power rails 31 can be made of any suitable electrically conductive material.

The electrical power rails 31 can be mounted to the complementary electrically conductive substrate 97 in accordance with any suitable embodiment as desired, such as a screw, pin, rivet, solder, weld, or the like. For instance, each of the electrical power rails 31 can include a mating portion 31*a* and a mounting portion 31*b*. The mating portion 31*a* can be received in the housing receptacle 77 and the 42 of the mating member 26 in the manner described above. The mounting portion 31*b* can flare out with respect to the mating portion 31*a*, and can be secured to the electrically conductive substrate 97. For instance, the mounting portion 31*b* can flare out in opposite directions from the mating portion 31*a*.

As described above, the electrical assembly 20 can include at least one electrical cable assembly 22 that can be placed in electrical communication with a common electrically conductive substrate 97. The common electrically conductive substrate 97 can be configured as a complementary electrical power bus 91 as illustrated in FIG. 8A. Alternatively, the electrically conductive substrate 97 can be configured as a printed circuit board 93 that includes a plurality of electrical traces that are placed in electrical communication with at least a respective one of the power rails 31 when the power rails 31 are mounted to the printed circuit board 93. For instance, the printed circuit board 93 can include a plurality of electrical contact pads 95 that are in electrical communication with respective ones of the electrical traces. The mounting portions 31*b* of the power rails 31 can be mounted to respective ones of the electrical contact pads 95.

Referring now to FIGS. 8C-8F, it should be appreciated that the electrical power rail 31 can be mounted to the complementary electrically conductive substrate 97 in accordance with any suitable embodiment as desired. For instance, the electrical assembly 20 can include an electrical connector 100 that is configured to be mounted to the electrically conductive substrate 97 and mated to the electrically conductive power rail 31, thereby placing the power rail 31 in electrical communication with the substrate 97. The electrical connector 100 can include a dielectric or electrically insulative connector housing 102, and at least one electrical conductor 104 supported by the connector housing 102. The connector housing 102 can define at least one housing receptacle 106, and the at least one electrical conductor 104 can be supported by the housing 102 so as to be aligned with the receptacle 106 along a mating direction, which can be defined by a longitudinal direction L. The connector housing 102 can receive the power rail 31 in the housing receptacle 106 along the mating direction, thereby placing the power rail 31 in electrical communication with the electrical conductor 104.

The at least one electrical conductor 104 can include a mating portion 104*a* and a mounting portion 104*b*. The mating portion 104*a* is configured to be mated to the electrical power rail 31. For instance, the mating portion 104*a* at least one electrical conductor 104 can extend into the housing receptacle 106, such that when the power rail 31 is received in the housing receptacle 106, the power rail contacts the mating portion 104*a*. In one example, the electrical connector 100 includes a pair of electrical conductors 104, such that the mating portion 104*a* of the electrical conductors 104 are disposed on opposite sides of the housing receptacle 106 with respect to a transverse direction T that is perpendicular to the longitudinal direction L. The mounting portion 104*b* is configured to be mounted to the substrate 97 in the manner described above.

Figure 8G:
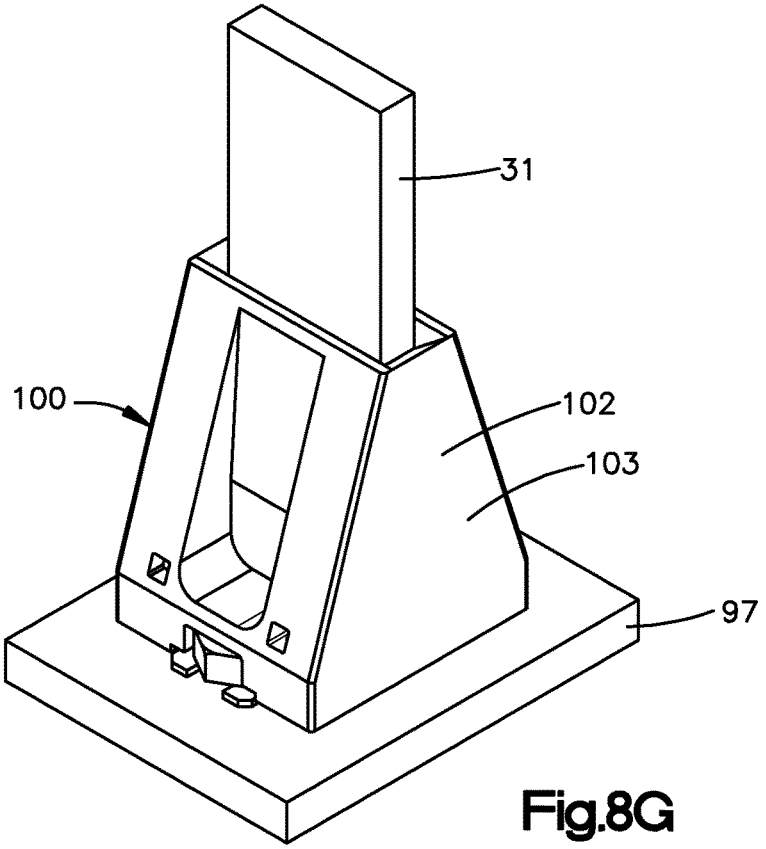
FIG. 8G is a perspective view of an electrical assembly constructed in accordance with another embodiment.
Figure 8H:
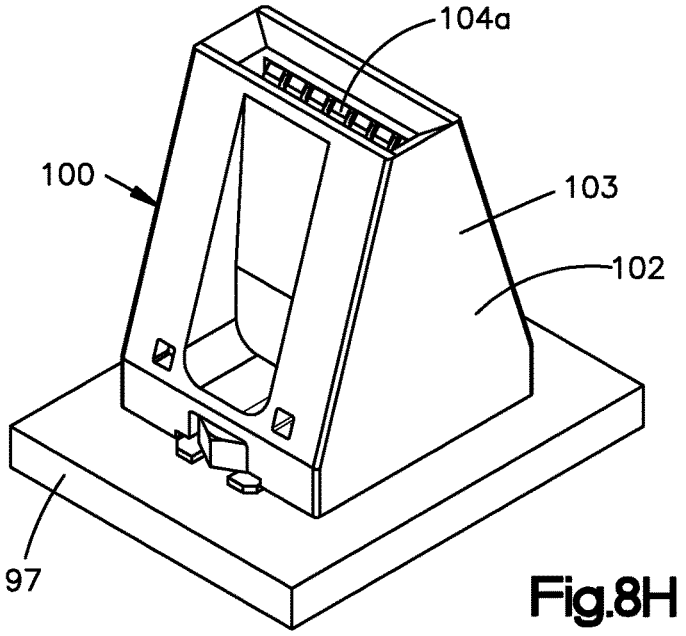
FIG. 8H is a perspective view of the electrical connector mounted to the complimentary power bus; of the electrical assembly illustrated in FIG. 8E.
Figure 9A:
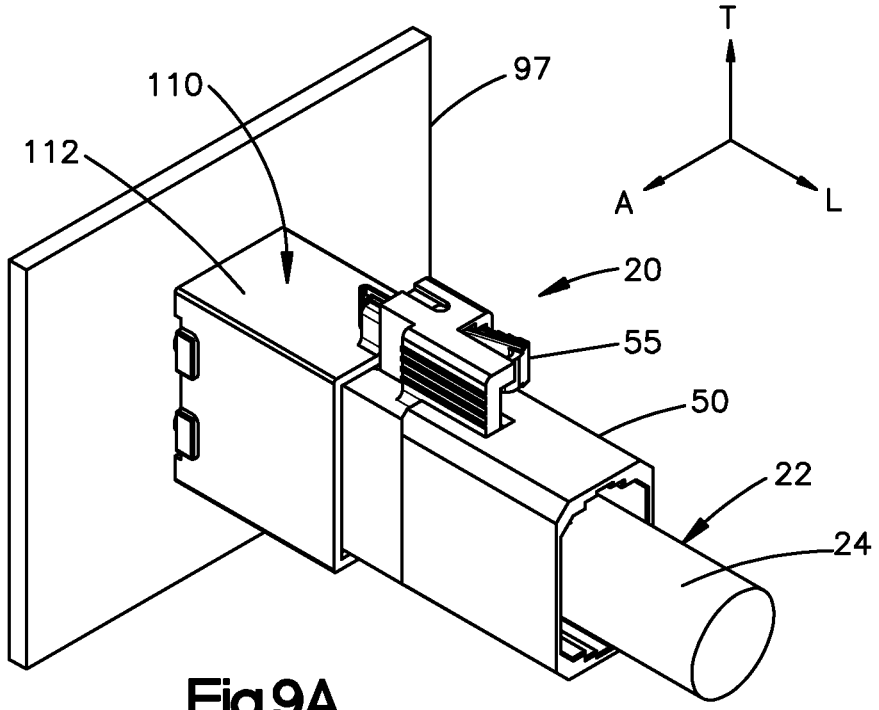
FIG. 9A is a perspective view of an electrical assembly, including a cable assembly, a power bus, and an electrical connector mounted to the power bus and mated to the cable assembly.
Figure 9B:
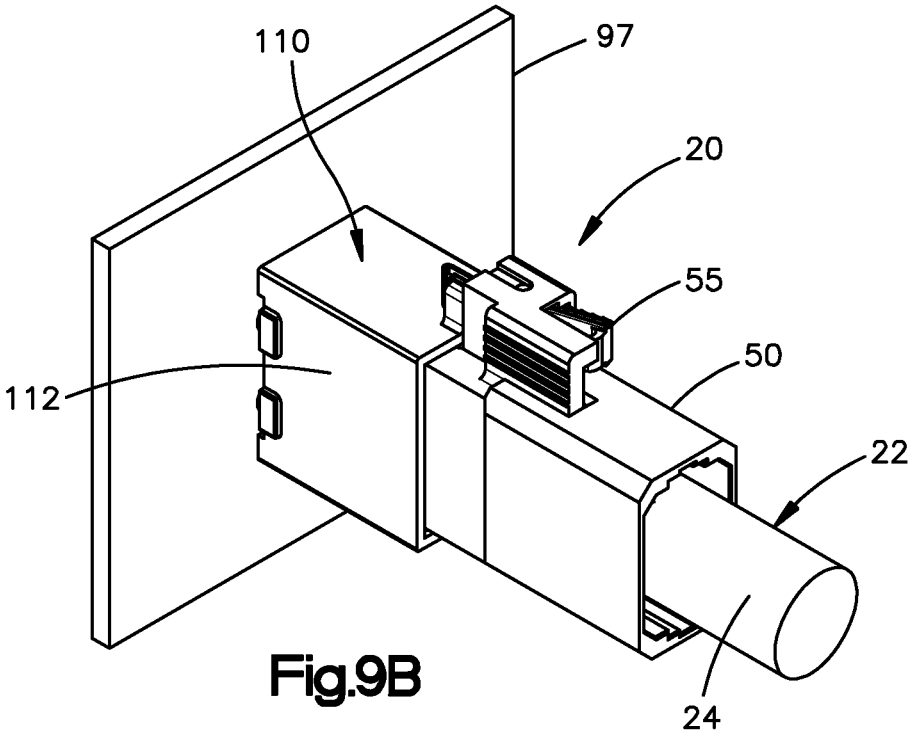
FIG. 9B is a perspective view of an electrical assembly, including a cable assembly, a power bus, and an electrical connector mounted to the power bus and mated to the cable assembly.
Figure 9C:
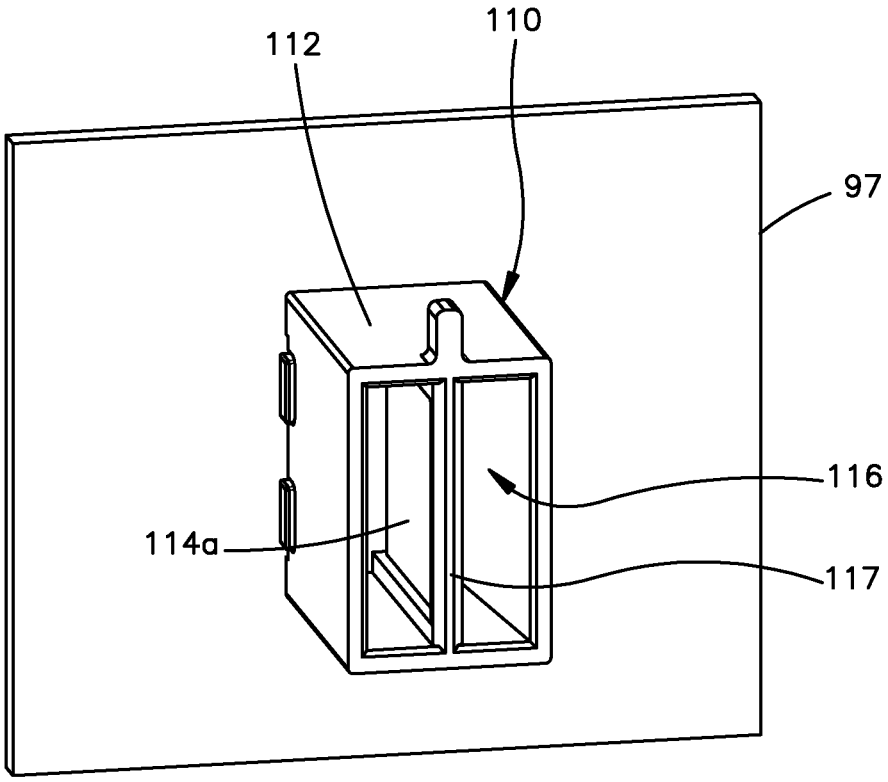
FIG. 9C is a perspective view of the electrical connector shown mounted to the complementary power bus as illustrated in FIG. 9A.
Figure 9D:
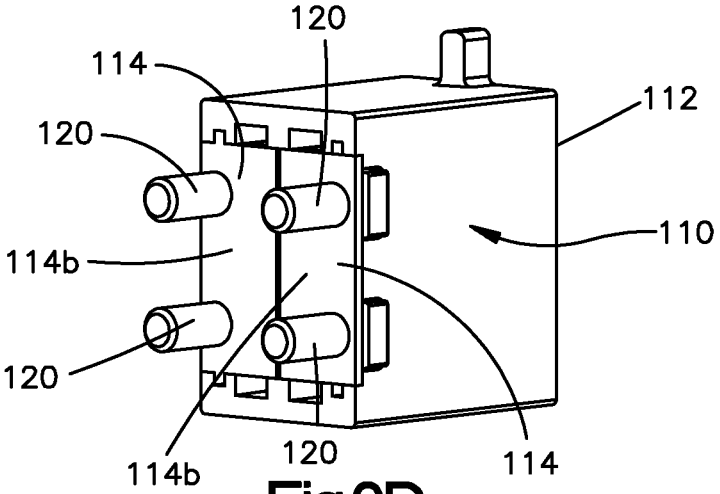
FIG. 9D is a perspective view of the electrical connector illustrated in FIG. 9C.
Figure 9E:
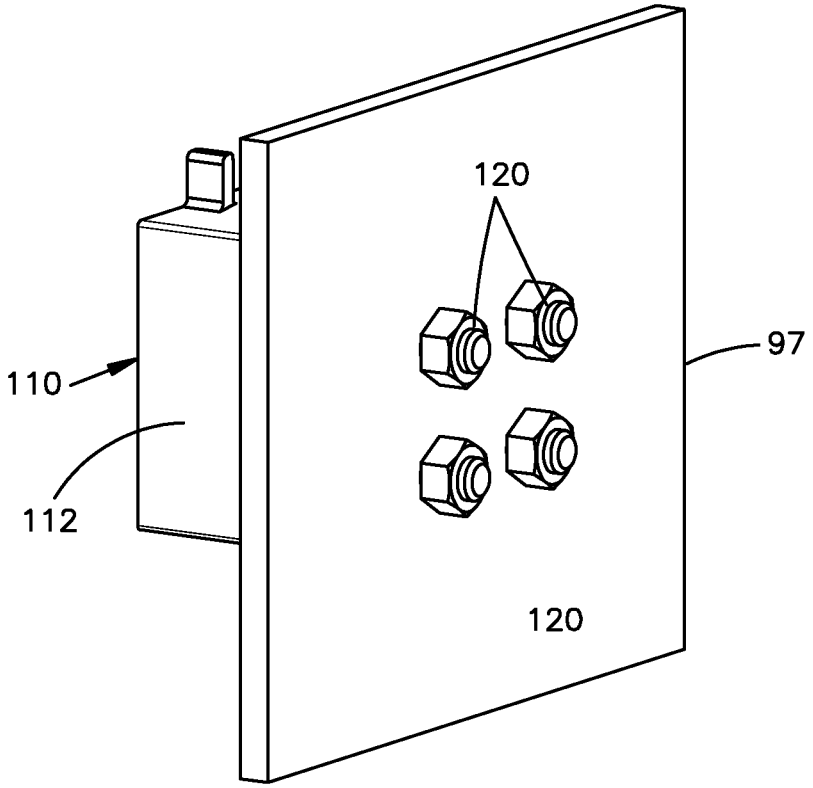
FIG. 9E is another perspective view of the electrical connector shown mounted to the complementary power bus as illustrated in FIG. 9C.
Figure 9F:
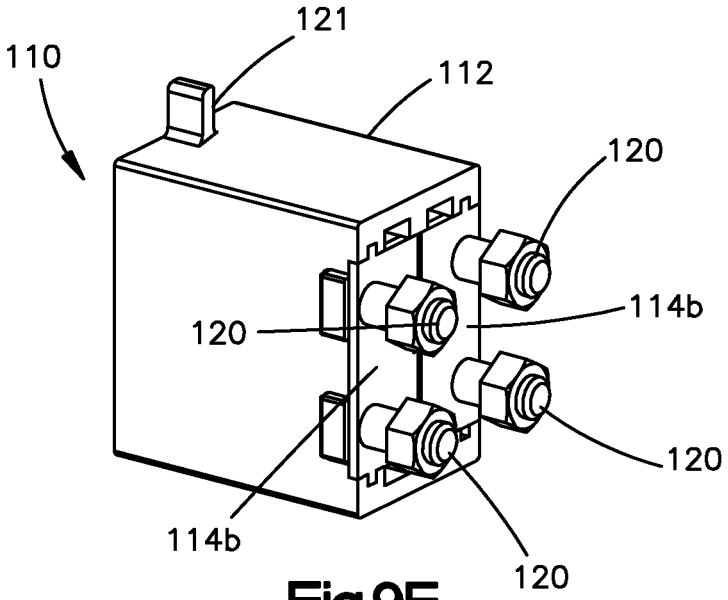
FIG. 9F is another perspective view of the electrical connector illustrated in FIG. 9D.

As illustrated in FIGS. 8C-8F, the housing receptacle 106 can be open at one or both of its ends with respect to a lateral direction A that is perpendicular to both the longitudinal direction L and the lateral direction A. For instance, the housing 102 can define side walls 103 that are opposite each other in the lateral direction. The housing 102 can define openings 105 that extend through the side walls 103 in the lateral direction A. The openings 105 are aligned with each other and the receptacle 106 along the lateral direction A. Accordingly, the power rail 31 that is received in the receptacle 106 can have a width in the lateral direction A that is greater than the width of the connector housing 102 in the lateral direction A. It should be appreciated that the power rail 31 can thus extend out from the receptacle 106 in one or both opposite directions along the lateral direction A when the power rail 31 is received in the receptacle. Alternatively, as illustrated in FIGS. 8G-8H, the housing receptacle 106 can be closed at both of its ends with respect to the lateral direction A. Thus, the power rail 31 that is received in the housing receptacle 106 has a width less than the width of the receptacle 106 with respect to the lateral direction A.

Referring now to FIGS. 4C and 9A-10B, it should be appreciated that the electrical cable assembly 22 can be placed in electrical communication with the substrate 97 in accordance with any suitable alternative embodiment as desired. For instance, the electrical assembly 20 can include an interposer 110 that is configured to be mounted to the electrically conductive substrate 97 and mated to the electrical cable assembly 22, thereby placing the at least one electrical cable 24 in electrical communication with the electrically conductive substrate 97. The interposer 110 can include a dielectric or electrically insulative interposer housing 112, and at least one electrical conductor 114 supported by the housing 112. The housing 112 can define at least one housing receptacle 116, and the at least one electrical conductor 114 can be supported by the housing 112 so as to be aligned with the receptacle 116 along a mating direction, which can be defined by a longitudinal direction L. The housing 112 can receive the housing 50 of the cable assembly 22 in the receptacle 116 so as to mate the electrically conductive mating member 26 with the at least one electrical conductor 114 (see also FIG. 4C).

For instance, the housing 112 can include a divider wall 117 that is disposed in the housing receptacle 116, and is configured to be received in the housing receptacle 77 when the electrical cable assembly 22 is mated to the interposer 110. The at least one electrical conductor 114 can include a mating portion 114*a* and a mounting portion 114*b*. The mating portion 114*a* is configured to be mated to the electrically conductive member 26 of the cable assembly 22. For instance, the mating portion 114*a* can extend 104 can extend along one side of the divider wall, such that the mating portion 114*a* is placed in contact with the electrically conductive member 26. In one example, the mating portion 114*a* is placed in contact with a respective arm 44 of the electrically conductive member 26. In one example, the electrical connector 100 includes a pair of electrical conductors 104, such that the mating portion 104*a* of the electrical conductors 104 are disposed on opposite sides of the divider wall 117 with respect to a lateral direction A that is perpendicular to the longitudinal direction L. The arms 44 of the electrically conductive member 26 can be placed into contact with respective ones of the mating portions 104*a* when the divider wall 117 is received in the housing receptacle 77.

Figure 10A:
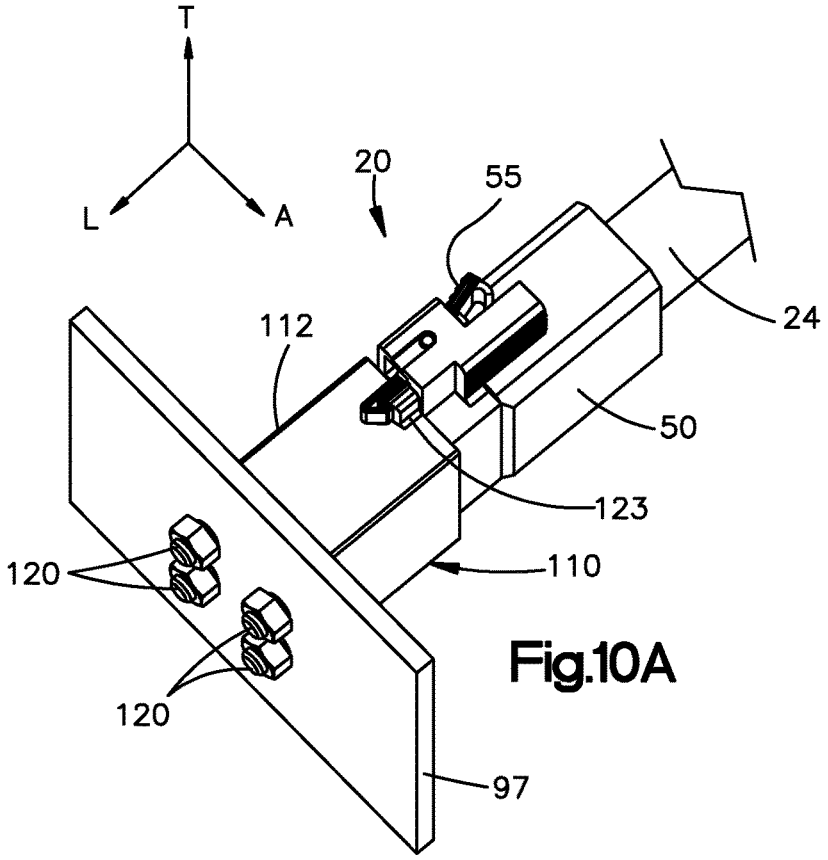
FIG. 10A is another perspective view of the electrical assembly illustrated in FIG. 9A.
Figure 10B:
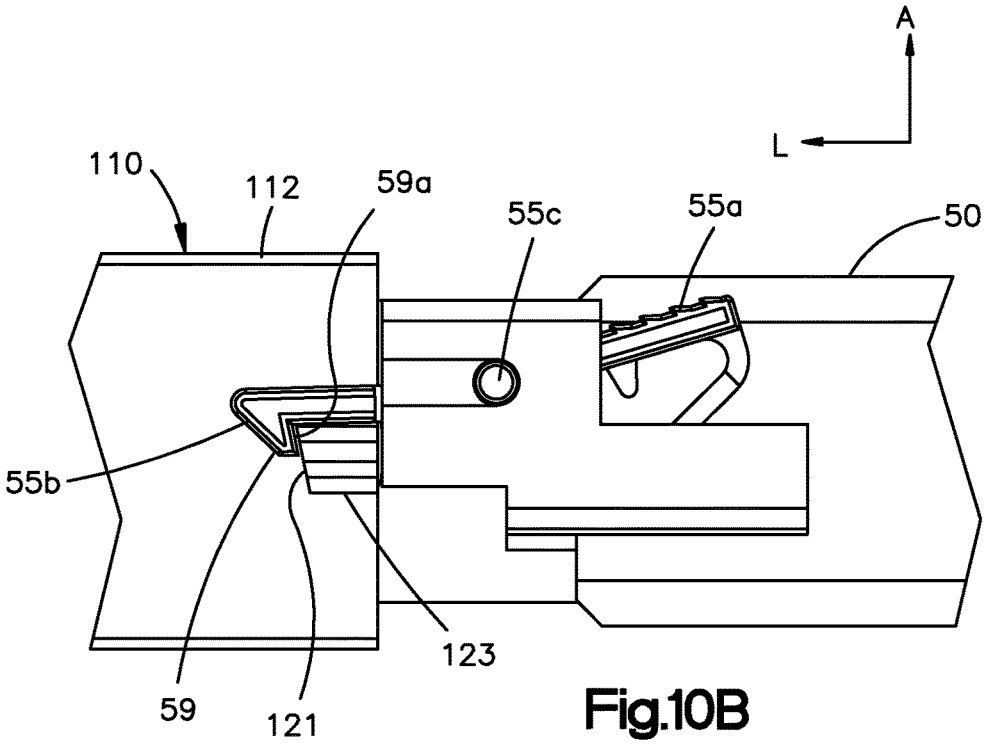
FIG. 10B is an enlarged perspective view of a portion of the electrical assembly illustrated in FIG. 10A, showing the electrical connector mated to the cable assembly.

Referring now to FIGS. 10A-10B, the housing 112 can include an engagement surface 121 that is configured to engage the projection 59 of the latch 55 so as to prevent removal of the housing 50 of the cable assembly 22 in a rearward direction that is opposite the forward mating direction. For instance, the housing 112 can include a projection 123 that defines the engagement surface 121. The engagement surface 121 can face the mating direction. The latch projection 59 can define an engagement surface 59*a* that is configured to abut the engagement surface 121. The engagement surface 59*a* can slope in a rearward direction as it extends out along the lateral direction A toward its distal end. Similarly, the engagement surface 121 can slope in a rearward direction as it extends out along the lateral direction A. Thus, the engagement surface 59*a* and the engagement surface 121 can be substantially parallel to each other. The respective slopes of the engagement surfaces 59*a* and 121 can prevent disengagement of the latch 55 from the projection 59 when a force is applied to one or both of the housings 50 and 112 in a direction opposite the mating direction.

With continuing reference to FIGS. 9A-9F, the mounting portions 104*b* of the electrical conductors 104 are configured to be mounted to the substrate 97 in the manner described above. The interposer 110 can include at least one fastener 120 that extends through the interposer housing 112, and through the underlying substrate 97 so as to attach the interposer 110 to the substrate 97 while the mounting portions 104*b* are mounted to the substrate 97.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the invention as described herein, and changes may be made without departing from the spirit and scope of the invention, for instance as set forth by the appended claims.

What is claimed is:

1. An electrical cable assembly comprising:

a plurality of stranded electrically conductive fibers of wire extending from a first end to a second end;

an electrical insulator surrounding the plurality of strands of wire, such that each of the first and second ends extends out from the electrical insulator, wherein the fibers of wire of at least the first end are fused to each other so as to define a solidified shape having at least one keyed surface;

a first electrically conductive contact member comprising at least one contact surface in surface contact with the at least one keyed surface of the solidified shape;

a first electrically conductive arm in electrical contact with the first electrically conductive contact member; and a second electrically conductive arm that cooperates with the first electrically conductive arm to define a receptacle.

2. The electrical cable assembly as recited in claim 1, wherein the at least one contact surface is in electrical communication with a mating member, thereby establishing an electrical connection between the first end and the mating member.

3. The electrical cable assembly as recited in claim 2, wherein the at least one keyed surface is fused to the at least one contact surface.

4. The electrical cable assembly as recited in claim 2, further comprising an electrically insulative material that surrounds at least a portion of the electrical insulator, surrounds the first end, and further surrounds the contact surface.

5. The electrical cable assembly as recited in claim 2, further comprising an electrically conductive plate that defines the mounting member and the at least one contact surface.

6. The electrical cable assembly as recited in claim 2, wherein the shaped first end defines a first centerline with respect to a lateral direction that is perpendicular to both the forward direction and the upward direction, the cable assembly further comprises a contact member that defines the contact surface, the contact member defining a second centerline with respect to the lateral direction, and the first and second centerlines are offset from each other along the lateral direction.

7. The electrical cable assembly as recited in claim 1, wherein the at least one keyed surface is a flat surface.

8. The electrical cable assembly as recited in claim 7, wherein the at least one contact surface is a flat surface.

9. The electrical cable assembly as recited in claim 1, wherein the plurality of stranded electrically conductive fibers of wire are braided with each other between the first end and a second end.

10. The electrical cable assembly as recited in claim 1, further comprising an electrically insulative housing that surrounds the mating member and is configured to be mounted onto a panel.

11. The electrical cable assembly as recited in claim 10, wherein the mating member is configured to be inserted into a channel of the housing along a forward direction, and the mating member comprises at least one latch arm that is configured to interfere with the housing so as to prevent removal of the mating member from the housing along a rearward direction opposite the forward direction.

12. The electrical cable assembly as recited in claim 10, wherein the housing comprises a housing body and a latch member rotatably supported by the housing body about a pivot axis so as to couple the latch member to a complementary electrical device.

13. The electrical cable assembly as recited in claim 12, wherein the housing further defines an anti-rotation wall that is configured to be inserted into a slot defined by the complementary electrical device so as to limit rotation of the housing body about an axis that extends through at least one or both of the aperture of the complementary electrical device and the head.

14. The electrical assembly as recited in claim 13, wherein the complementary electrical device comprises a power rail, the electrical assembly further comprising an electrically conductive substrate, wherein the power rail is configured to be mounted to the electrically conductive substrate.

15. The electrical cable assembly as recited in claim 1, wherein the fibers of wire are ultrasonically bonded, welded, or soldered to each other at the at least one of the first and second ends so as to fuse the fibers of wire to each other at the at least one of the first and second ends.

16. The electrical cable of claim 1, wherein the solidified shape is configured to only allow surface contact between the at least one keyed surface and the at least one contact surface if the solidified shape is in one or more predetermined orientations relative to the at least one contact surface.

17. An electrical cable assembly comprising:

a plurality of stranded electrically conductive fibers of wire extending from a first end to a second end;

an electrical insulator surrounding the plurality of strands of wire, such that each of the first and second ends extends out from the electrical insulator, wherein the fibers of wire of at least one of the first and second ends are shaped so as to define at least one keyed surface, and fused to each other while shaped so as to define a solidified shape having the at least one keyed surface, prior to electrically connecting the at least one of the first and second ends to a mating member or mounting member, respectively;

first and second electrically conductive arms that cooperate with each other so as to define the receptacle of the mating member; and an electrically conductive shroud having first and second shroud arms that are disposed adjacent and outboard the first and second electrically conductive arms, respectively, such that each of the first and second electrically conductive arms is disposed between the first and second shroud arms.

18. The electrical cable assembly as recited in claim 17, wherein the electrically conductive shroud comprises first and second shroud members that are separate from each other, wherein each of the first and second shroud members includes first and second shroud arms that are disposed adjacent and outboard the first and second electrically conductive arms, respectively, such that each of the first and second electrically conductive arms is disposed between the first and second shroud arms.

19. An electrical cable assembly comprising:

a plurality of stranded electrically conductive fibers of wire extending from a first end to a second end;

an electrical insulator surrounding the plurality of strands of wire, such that each of the first and second ends extends out from the electrical insulator, wherein the fibers of wire of at least one of the first and second ends are fused to each other so as to define a rectangular tab having a first flat surface and a second flat surface opposed to the first flat surface;

a first conductive contact member comprising:

a first contact surface, wherein the first flat surface of the rectangular tab is in surface contact with the first contact surface of the first conductive contact member; and a second contact surface, wherein the second flat surface of the rectangular tab is in surface contact with the second contact surface of the first conductive contact member; and at least one electrically conductive arm in electrical contact with the first and second electrically conductive contact member.

20. The electrical cable assembly of claim 19, wherein:

the rectangular tab is a first rectangular tab;

the first conductive contact member comprises a second rectangular tab;

the second conductive contact member comprises a third rectangular tab; and the first rectangular tab is located between the second rectangular tab and the third rectangular tab.

* * * * *